US008549675B2

(12) United States Patent
Abbondanzio et al.

(10) Patent No.: US 8,549,675 B2
(45) Date of Patent: Oct. 8, 2013

(54) TOILET BOWL CLEANING DEVICE INCLUDING DUAL ACTIVATION MECHANISM

(75) Inventors: Matthew Abbondanzio, Milwaukee, WI (US); Ronald J. Schmidt, Grayslake, IL (US); Jeffrey L. Crull, McFarland, WI (US); Paresh Shroff, Palatine, IL (US); Kristian Buschmann, Chicago, IL (US); Steven V. Bisbikis, Hawthorn Woods, IL (US)

(73) Assignee: S.C. Johnson & Son, Inc., Racine, WI (US)

( * ) Notice: Subject to any disclaimer, the term of this patent is extended or adjusted under 35 U.S.C. 154(b) by 1 day.

(21) Appl. No.: 13/302,834

(22) Filed: Nov. 22, 2011

(65) Prior Publication Data

US 2012/0131738 A1 May 31, 2012

Related U.S. Application Data

(60) Provisional application No. 61/417,384, filed on Nov. 26, 2010.

(51) Int. Cl.
*E03D 9/02* (2006.01)

(52) U.S. Cl.
USPC ..... 4/223

(58) Field of Classification Search
USPC ..... 4/222–233; 222/173
See application file for complete search history.

(56) References Cited

U.S. PATENT DOCUMENTS

| | | | |
|---|---|---|---|
| 1,366,426 | A | 1/1921 | Silvers |
| 1,385,985 | A | 8/1921 | Decker |
| 2,075,266 | A | 3/1937 | Bowman |
| 2,166,772 | A | 7/1939 | Salsas-Serra |
| 2,397,677 | A | 4/1946 | MacGlashan |
| 2,614,265 | A | 10/1952 | Vierra |
| 2,760,209 | A | 8/1956 | Ewing et al. |
| 2,796,293 | A | 6/1957 | Becker |
| 3,088,125 | A | 5/1963 | Southwood |
| 3,128,018 | A | 4/1964 | Corsette et al. |

(Continued)

FOREIGN PATENT DOCUMENTS

| | | | |
|---|---|---|---|
| DE | 2721433 | A1 | 11/1978 |
| EP | 0 274 785 | A1 | 7/1988 |

(Continued)

OTHER PUBLICATIONS

PCT/US2011/061797 International Search Report dated Mar. 5, 2012.

(Continued)

*Primary Examiner* — Lori Baker

(57) ABSTRACT

A device for spraying an inner surface of a toilet bowl with a cleaning and/or deodorizing chemical is disclosed. The device includes a container for the chemical, a container holder, a sprayer through which the chemical can be sprayed laterally at least halfway around a perimeter of the sprayer, means for attaching the sprayer near a rim of the toilet bowl, and a fluid conduit in fluid communication with the container and the sprayer. The toilet bowl cleaning device can include a hand or foot actuated lever for releasing a fluid from the container into a fluid delivery system, and a clip for mounting the sprayer adjacent an inner wall of the toilet bowl wherein the clip can be adjusted to fit different size toilet bowls.

19 Claims, 18 Drawing Sheets

(56) References Cited

U.S. PATENT DOCUMENTS

| | | | | |
|---|---|---|---|---|
| 3,178,070 | A | | 4/1965 | Leland |
| 3,532,273 | A | | 10/1970 | Siddall et al. |
| 3,940,027 | A | | 2/1976 | Marterer |
| 3,946,448 | A | | 3/1976 | Sioufy |
| 3,953,902 | A | | 5/1976 | Taylor |
| 4,072,247 | A | | 2/1978 | Yamazaki |
| 4,077,750 | A | | 3/1978 | Hake |
| 4,183,105 | A | | 1/1980 | Womack |
| 4,273,257 | A | | 6/1981 | Smith et al. |
| 4,391,309 | A | | 7/1983 | Steiner |
| 4,407,217 | A | | 10/1983 | Jackson |
| RE32,017 | E | | 11/1985 | Hautmann et al. |
| 4,560,108 | A | | 12/1985 | Rubinstein |
| 4,562,867 | A | | 1/1986 | Stouffer |
| 4,618,077 | A | | 10/1986 | Corsette |
| 4,660,765 | A | | 4/1987 | Rosenberg |
| 4,670,916 | A | | 6/1987 | Bloom |
| 4,747,523 | A | | 5/1988 | Dobbs |
| 4,763,839 | A | | 8/1988 | Greenberg |
| 4,777,670 | A | | 10/1988 | Klinkhammer et al. |
| 4,817,869 | A | | 4/1989 | Rubinstein |
| 4,873,729 | A | | 10/1989 | Micallef |
| 5,022,098 | A | | 6/1991 | Brower |
| 5,123,124 | A | | 6/1992 | Brower |
| 5,143,293 | A | | 9/1992 | Pairis |
| 5,203,506 | A | | 4/1993 | Gross et al. |
| 5,347,661 | A | | 9/1994 | Fly et al. |
| 5,457,822 | A | | 10/1995 | Klammsteiner |
| 5,829,066 | A | * | 11/1998 | Aibe ..... 4/213 |
| 5,862,532 | A | * | 1/1999 | Cain ..... 4/228.1 |
| 5,906,298 | A | | 5/1999 | Ward |
| 6,000,067 | A | | 12/1999 | Cascia |
| 6,015,067 | A | | 1/2000 | Lang et al. |
| 6,016,972 | A | | 1/2000 | Kantor et al. |
| 6,029,286 | A | | 2/2000 | Funk |
| 6,162,371 | A | | 12/2000 | Rees et al. |
| 6,178,563 | B1 | | 1/2001 | Helfet |
| 6,178,564 | B1 | | 1/2001 | Leonard et al. |
| 6,230,334 | B1 | | 5/2001 | Camp et al. |
| 6,279,174 | B1 | | 8/2001 | Candusso |
| 6,347,414 | B2 | | 2/2002 | Contadini et al. |
| 6,394,310 | B1 | | 5/2002 | Muderlak et al. |
| 6,425,406 | B1 | | 7/2002 | Klinkhammer et al. |
| 6,471,974 | B1 | | 10/2002 | Rees et al. |
| 6,494,384 | B1 | | 12/2002 | Meyer |
| 6,505,356 | B1 | | 1/2003 | Leonard et al. |
| 6,588,026 | B2 | | 7/2003 | Meier et al. |
| 6,651,261 | B1 | | 11/2003 | Leonard et al. |
| 6,675,396 | B2 | | 1/2004 | Varanasi et al. |
| 6,694,536 | B1 | | 2/2004 | Haygreen |
| 6,702,157 | B1 | | 3/2004 | Dobbs |
| 6,739,479 | B2 | | 5/2004 | Contadini et al. |
| 6,769,580 | B2 | | 8/2004 | Muderlak et al. |
| 6,772,450 | B1 | | 8/2004 | Saylor et al. |
| 6,812,196 | B2 | | 11/2004 | Rees et al. |
| 6,820,821 | B2 | | 11/2004 | Linstedt et al. |
| 6,898,806 | B2 | | 5/2005 | Keramidas |
| 6,932,279 | B2 | | 8/2005 | Burcham |
| 6,944,890 | B1 | | 9/2005 | Sim |
| 6,971,549 | B2 | | 12/2005 | Leifheit et al. |
| 6,976,277 | B2 | | 12/2005 | Keramidas |
| 6,978,947 | B2 | * | 12/2005 | Jin ..... 239/337 |
| 7,007,312 | B1 | | 3/2006 | Sim |
| 7,021,494 | B2 | | 4/2006 | Mazooji et al. |
| 7,114,199 | B2 | | 10/2006 | Conway et al. |
| 7,143,957 | B2 | | 12/2006 | Nelson |
| 7,603,726 | B2 | * | 10/2009 | Sawalski et al. ..... 4/223 |
| 8,061,562 | B2 | * | 11/2011 | Carpenter et al. ..... 222/52 |
| 2002/0130146 | A1 | | 9/2002 | Borut et al. |
| 2002/0148908 | A1 | * | 10/2002 | Linstedt et al. ..... 239/223 |
| 2002/0178908 | A1 | | 12/2002 | Kato et al. |
| 2003/0056587 | A1 | | 3/2003 | Carpenter et al. |
| 2003/0188377 | A1 | | 10/2003 | Contadini et al. |
| 2004/0050959 | A1 | * | 3/2004 | Mazooji et al. ..... 239/263.1 |
| 2005/0005378 | A1 | | 1/2005 | Soller et al. |
| 2005/0133540 | A1 | | 6/2005 | Hornsby et al. |
| 2006/0006253 | A1 | | 1/2006 | Nelson |
| 2007/0000941 | A1 | | 1/2007 | Hadden et al. |
| 2007/0040045 | A1 | | 2/2007 | Cohen |
| 2007/0045337 | A1 | | 3/2007 | Hornsby et al. |
| 2007/0136937 | A1 | | 6/2007 | Sawalski et al. |
| 2007/0158359 | A1 | | 7/2007 | Rodrian |
| 2007/0187427 | A1 | | 8/2007 | Shaw et al. |
| 2007/0204387 | A1 | | 9/2007 | Cornelius et al. |
| 2007/0204388 | A1 | | 9/2007 | Zyskowski et al. |
| 2007/0204389 | A1 | | 9/2007 | Graefe et al. |
| 2007/0240251 | A1 | | 10/2007 | Pagani |
| 2007/0245470 | A1 | | 10/2007 | Nguyen et al. |
| 2007/0289054 | A1 | | 12/2007 | Han et al. |
| 2008/0078780 | A1 | | 4/2008 | Sanger et al. |
| 2009/0000016 | A1 | * | 1/2009 | Sawalski et al. ..... 4/223 |

FOREIGN PATENT DOCUMENTS

| | | | | |
|---|---|---|---|---|
| EP | 1078868 | A1 | | 2/2001 |
| FR | 2588742 | A | | 4/1987 |
| FR | 2874038 | | | 2/2006 |
| GB | 215407 | A | | 5/1924 |
| GB | 264364 | A | | 1/1927 |
| GB | 1140900 | A | | 2/1969 |
| GB | 2296670 | A | | 7/1996 |
| JP | 1-97423 | | | 4/1989 |
| JP | 3-9714 | | | 1/1991 |
| JP | 3-228718 | | | 1/1991 |
| JP | 5-222757 | | | 8/1993 |
| JP | 6-170286 | | | 6/1994 |
| JP | 009075796 | | * | 3/1997 |
| JP | 9075796 | A | | 3/1997 |
| JP | 2000-70797 | A | | 3/2000 |
| JP | 2000-166818 | A | | 6/2000 |
| JP | 2002-04884 | | | 2/2002 |
| JP | 2002-180518 | | | 6/2002 |
| JP | 2002-286833 | | | 10/2002 |
| JP | 2004-100212 | | | 4/2004 |
| JP | 2004-283811 | | | 10/2004 |
| JP | 2005-36511 | | | 2/2005 |
| JP | 2005-46769 | | | 2/2005 |
| JP | 2005-52754 | | | 3/2005 |
| JP | 2005-103367 | | | 4/2005 |
| JP | 2005-211164 | | | 8/2005 |
| JP | 2005-344300 | | | 12/2005 |
| RO | 117293 | B | | 1/2002 |
| WO | WO93/03232 | A | | 2/1993 |
| WO | 99/66139 | A1 | | 12/1999 |
| WO | 99/66140 | A1 | | 12/1999 |
| WO | 00/58573 | A | | 10/2000 |
| WO | 01/14652 | A1 | | 3/2001 |
| WO | 01/44591 | A1 | | 6/2001 |
| WO | 2005/070474 | A1 | | 8/2005 |
| WO | 2006/013321 | A1 | | 2/2006 |
| WO | 2007/075819 | A | | 7/2007 |
| WO | 2008044201 | | | 4/2008 |
| WO | 2008076346 | | | 6/2008 |

OTHER PUBLICATIONS

International Search Report and Written Opinion dated Nov. 17, 2008, Appl. No. PCT/US2008/005716.
Microsprinkler shown at www.dripirrigation.com, 3 pages.
English Language Abstract of JP 1-97423.
English Language Machine Translation of JP 2002-180518.
English Language Machine Translation of JP 2005-344300.
English Language Machine Translation of JP 2004-100212.
English Language Machine Translation of JP 2002-286833.
English Language Machine Translation of JP 2005-36511.
English Language Machine Translation of JP 2005-211164.
English Language Machine Translation of JP 2005-103367.
English Language Machine Translation of JP 2005-52754.
English Language Machine Translation of JP 2005-46769.
English Language Machine Translation of JP 2004-283811.
English Language Abstract of FR 2588742.
English Language Machine Translation of JP 2000-166818.
English Language Translation of JP 2000-70797.

English Language Translation of JP 6-170286.
English Language Machine Translation of JP 5-222757.
English Language Machine Translation of JP 2002-048884.
English Language Abstract of JP 3-9714.
English Language Abstract of JP 3-228718.
English Language Abstract of FR 2874038.

* cited by examiner

TOILET BOWL CLEANING DEVICE INCLUDING DUAL ACTIVATION MECHANISM

CROSS-REFERENCES TO RELATED APPLICATIONS

This application claims priority from U.S. Patent Application No. 61/417,384 filed Nov. 26, 2010.

STATEMENT REGARDING FEDERALLY SPONSORED RESEARCH

Not Applicable.

BACKGROUND OF THE INVENTION

1. Field of the Invention

This invention relates to a toilet bowl cleaning device where the inner surface of the toilet bowl can be cleaned around the entire circumference of the toilet bowl at locations below the toilet waterline, and/or locations at the toilet waterline, and/or locations above the toilet waterline, and/or locations under the toilet rim. The toilet bowl cleaning device includes a hand or foot actuated lever for releasing a fluid from the container into a fluid delivery system and a clip for mounting a fluid sprayer adjacent an inner wall of the toilet bowl wherein the clip can be adjusted to fit different size toilet bowls.

2. Description of the Related Art

Toilet bowls require care to prevent the buildup of unsightly deposits, to reduce odors, and to prevent bacteria growth. Traditionally, toilet bowls have been cleaned, deodorized, and disinfected by manual scrubbing with a liquid or powdered cleaning and sanitizing agent. This task has required manual labor to keep the toilet bowl clean.

In order to eliminate the detested manual scrubbing, various toilet bowl cleaner dispensers have been proposed. One type of dispenser comprises a solid block or solid particles of a cleansing and freshening substance that is suspended from the rim of a toilet bowl in a container that is placed in the path of the flushing water. U.S. Pat. No. 4,777,670 (which is incorporated herein by reference along with all other documents cited herein) shows an example of this type of toilet bowl cleaning system. Typically, a portion of the solid block is dissolved in the flush water with each flush, and the flush water having dissolved product is dispensed into the toilet bowl for cleaning the bowl.

Other toilet bowl cleaning systems use a liquid cleaning agent that is dispensed into a toilet bowl. For example, U.S. Pat. Nos. 6,178,564 and 6,230,334, and PCT International Publication Nos. WO 99/66139 and WO 99/66140 all disclose cleansing and/or freshening devices capable of being suspended from the rim of a toilet bowl for introducing liquid active substances from a bottle into the flushing water with each flush. In these under the toilet rim devices, the liquid active substances are delivered downward from a reservoir to a dispensing plate that is supported by a base that is suspended from the toilet bowl rim. The device is suspended from the toilet rim such that the flow of flush water from the toilet contacts the dispensing plate during a flush. The flush water carries the liquid active substances that are on the dispensing plate into the toilet bowl to clean and freshen the toilet.

Other toilet bowl dispensers use an aerosol deodorizing and/or cleaning agent that is dispensed into a toilet bowl through a conduit attached to the toilet bowl rim. For example, U.S. Pat. No. 3,178,070 discloses an aerosol container mounted by a bracket on a toilet rim with a tube extending over the rim; and U.S. Pat. Nos. 6,029,286 and 5,862,532 disclose dispensers for a toilet bowl including a pressurized reservoir of fluid, a conduit connected to the source of fluid, and a spray nozzle which is installed on the toilet rim.

One disadvantage with these known toilet rim dispensing devices is that these devices may only apply the deodorizing and/or cleaning agent to one location in the toilet water or a limited area in the toilet water or on the inner surface of the toilet bowl. As a result, the cleaning of the inner surface of the toilet bowl may be limited to an area of the toilet bowl near the device. This is a drawback as it is desirable to obtain uniform application of cleaning fluid in the entire toilet bowl.

U.S. Pat. No. 7,603,726 sets forth, among others, an automatic or manual toilet bowl cleaning device where the inner surface of the toilet bowl is cleaned around the entire circumference of the toilet bowl. In one embodiment illustrated in that application, the downstream end of a fluid conduit terminates in a rotating nozzle capable of spraying the fluid outwardly onto the inner surface of the toilet bowl. The fluid is stored in a container until the fluid is released into the fluid conduit. Various methods for triggering the release of fluid from the container are described in U.S. Pat. No. 7,603,726.

Several techniques are also available to provide adjustment for devices attached to the rim of a toilet bowl. Adjustment has been generally limited to either (1) accommodating toilet bowl rims of varying width, as shown in U.S. Pat. No. 6,029,286 wherein a ratchet arrangement between two members of the hook is used to adjust the hook for varying rim widths, or (2) attempting to accommodate the depth of the rim and bowl geometry by adjusting the vertical position of the device below the rim. For example, U.S. Pat. No. Re. 32,017 and U.S. Pat. Nos. 6,898,806 and 7,114,199 incorporate a ratchet arrangement between the hook and the body to allow discrete vertical adjustment of the device below the rim of a toilet bowl. Furthermore, U.S. Pat. No. 6,675,396 allows for continuous adjustment of the body with respect to the rim by the use of a friction fit wherein a flat bar hook is wedged within a hollow channel formed within the body. U.S. Patent Application Publication Nos. 2007/0240252 and 2008/0017762 also show various clips for mounting a nozzle near the rim of the toilet bowl.

However, there is still a need for improved devices for triggering the release of fluid from the container. There is also still a need for an improved clip for mounting a nozzle near the rim of the toilet bowl having adjustment means that adequately position the nozzle so that the dispensed fluid reaches the extremes of the inner surface of the toilet bowl when the toilet bowl has an asymmetric or elongated rim/inner surface configuration. Thus, even further improvements to this technology would be beneficial to consumers.

SUMMARY OF THE INVENTION

The foregoing needs can be met with a toilet bowl cleaning and/or deodorizing device according to the invention that delivers a chemical into the toilet bowl. The term "chemical" or "chemistry" means one chemical or a mixture of chemical ingredients. Various cleaning and/or deodorizing chemicals are suitable for use with a toilet bowl cleaning device according to the invention. The toilet bowl cleaning and/or deodorizing device includes appropriate chemistry and a dispensing system. As used herein, the term "cleaning" also includes sanitizing and/or disinfecting, and the term "deodorizing" also includes freshening.

Regarding the chemistry, a chemical is applied directly onto the inner surface of the toilet bowl and/or into the toilet water so as to clean and freshen the toilet bowl. If applied to the inner surface of the toilet bowl, the chemical will typically be a liquid (single or multiple chemistries). If added to the toilet water, the chemistry can also be a liquid (single or multiple chemistries) that is added to the water to act as a preventive, or to create an environment that will work to clean the toilet automatically.

With respect to the dispensing system, the system includes several subsystems which are the means for applying the appropriate chemistry to the inner surface of the toilet bowl to conduct the cleaning process. The dispensing system may include (but is not limited to): (i) a chemistry storage container; (ii) a chemical propulsion system; (iii) a chemical delivery system; and (iv) a toilet interface.

The chemistry storage container is used to hold and store the chemistry used to clean the toilet bowl. Non-limiting examples include a standard plastic bottle, such as that found on a trigger sprayer.

The chemical propulsion system provides a method of providing the appropriate energy to the chemistry to move it through the delivery system so that it can move from the storage container to the appropriate area within the toilet bowl. Examples of this subsystem include a pump or pumping mechanism to move a liquid such as a vein pump, bellows pump, impeller driven pump, piston pump, peristaltic pump or gear driven pump.

The chemical delivery system provides a method of moving chemistry from its storage container to the appropriate area within the toilet bowl. This delivery subsystem can include a hose and a sprayer (e.g., a nozzle).

The toilet interface provides a means and method of attachment to the toilet to keep the hose out of the way, keep it uncrimped, and secure the sprayer nozzle into place on the toilet rim or toilet lid.

These subsystems work together to deliver the appropriate chemistry (using predetermined amounts) to deliver the desired consumer benefit.

Therefore, in one aspect, the invention provides for a holder for receiving a container with fluid that has a valve stem, where the holder includes a base with a manifold. The manifold has an inlet, an outlet, and a fitment to engage the valve stem. The inlet is in fluid communication with the outlet. The holder also includes a triggering device that has a first flange on one end and a second flange on an opposite end. The triggering device is configured to move between a first position and a second position upon pressure being supplied to at least one of the first flange and the second flange, and the triggering device engages the container in the second position such that the fitment moves the valve stem relative to the container to supply the fluid to the inlet.

In another form, the invention provides for a holder wherein the first flange extends away from the triggering device in a first direction and the second flange extends away from the triggering device in a second direction. The first direction is opposite from the second direction.

In yet another form, the invention provides for a holder wherein the first flange forms a top portion of the holder.

In a further form, the invention provides for the triggering device to engage the container in the second position by contact of the first flange with the container.

In still yet another form, the invention provides for a holder wherein upon the triggering device engaging the container in the second position, the container is moved downward through contact with the first flange.

In another form, the invention provides for the triggering device to move from the first position to the second position from a user's hand applying the force to the first flange.

In yet another form, the invention provides for the triggering device to move from the first position to the second position from a user's foot applying the force to the second flange.

In another form, the invention provides for a holder with a triggering device that further includes a triggering device wall projecting from the first flange, wherein the triggering device wall is configured to support a side of the container.

In a further form, the invention provides for a holder where the triggering device wall is further configured to slide between the container and the base when the triggering device is moved from the first position to the second position.

In another form, the container includes a retainer, and the base includes two or more fingers dimensioned such that each of the fingers flexes outwardly when contacted by the retainer during installation of the container in the holder.

In yet another form, the invention provides for a holder that further includes a check valve. The check valve is downstream of the outlet.

In another aspect, the invention provides for a device for spraying an inner surface of a wall of an enclosure with a fluid. The device includes a container for the fluid, a holder for receiving a container with fluid that has a valve stem, where the holder includes a base with a manifold and a triggering device with a first flange on one end and a second flange on an opposite end and configured to move between a first position and a second position. The manifold has an inlet, an outlet, and a fitment to engage the valve stem. The inlet is in fluid communication with the outlet. The triggering device is configured to move between a first position and a second position upon pressure being supplied to at least one of the first flange and the second flange, and the triggering device engages the container in the second position such that the fitment moves the valve stem relative to the container to supply the fluid to the inlet. The device also includes a fluid conduit in fluid communication with the outlet and a fluid sprayer and a means for attaching the fluid sprayer near the inner surface of the wall of the enclosure.

In one form, the device is configured such that the first flange extends away from the triggering device in a first direction and the second flange extends away from the triggering device in a second direction. The first direction is opposite from the second direction.

In another form, the invention provides for a device wherein the first flange forms a top portion of the holder.

In a different form, the invention provides for a device such that the triggering device engages the container in the second position by contact of the first flange with the container.

In yet another form, the device is configured such that upon the triggering device engaging the container in the second position, the container is moved downward through contact with the first flange.

In another form, the invention provides for a device, wherein upon the triggering device engaging the container in the second position, fluid exits the container, travels through the conduit, moves through the fluid sprayer, and is sprayed on the wall of the enclosure.

In still another form, the invention provides for a device wherein the enclosure is a toilet bowl.

In yet another aspect, the invention provides for a retention mechanism for a dispenser including a container and a holder for receiving the container in an opening of the holder. The retention mechanism includes a retainer dimensioned to engage the container, the retainer including a projection extending outwardly from the retainer with a cavity in the projection, and a fitment which forms part of the holder and is dimensioned such that the fitment is received within the cavity of the projection. The cavity has a corresponding shape to the fitment.

In one form, the invention provides for a retention mechanism where the cavity and fitment are cylindrical in shape.

In a different form, the retention mechanism also includes a base wall that forms part of a base of the holder, where the base wall is configured to support a portion of the container.

In yet another form, the invention provides for a retention mechanism that also includes a triggering device wall that forms part of a triggering device of the holder, with the triggering device wall configured to support a portion of the container.

In still another aspect, the invention provides for a refill for a sprayer system including a container holder and a fluid conduit in fluid communication with an outlet of the container holder and a fluid sprayer. The refill includes a container and a retainer connected to the container. The retainer includes a cylindrical projection extending outwardly from the retainer with a cavity in the projection.

In one form, the invention provides for a refill where the container is an aerosol can having a valve cup rim surrounding a valve stem, and the retainer includes a central annular wall dimensioned to engage the valve cup rim.

In a different form, the invention provides for a refill where a portion of the retainer engages a dome of the aerosol can.

In another form, the invention provides for a refill wherein the cavity in the projection of the retainer is configured to receive a fitment that forms part of the container holder to retain the refill in the container holder.

In another aspect, the invention provides a clip for mounting a fluid delivery device adjacent a wall of an enclosure. The clip includes a support having a first side and an opposite second side, a base attached to the support wherein the base is structured for attaching the fluid delivery device to the base, a first arm having a first section extending laterally from the support and a second section extending downward from the first section, and a second arm having a first segment extending laterally from the support and a second segment extending downward from the first segment. The first arm and the second arm have an equilibrium position in which the first section and the first segment form a first angle facing away from the second side of the support. At least one of the first arm and the second arm can be elastically deflected to create a flexed position in which the first section and the first segment form a second angle facing away from the second side of the support. The second angle is less than the first angle.

In another form of the clip, the first arm and the second arm comprise part of a helical torsion spring, and the helical torsion spring is connected to the support, and the first arm and the second arm extend from opposite sides of the helical torsion spring.

In yet another form of the clip, the base is slidingly attached to the support.

In still another form of the clip, a biasing means is attached to the base and the support for biasing the base toward an end of the support.

In yet another form of the clip, the biasing means is a spring.

In still another form of the clip, the biasing means is housed within the support.

In yet another form of the clip, the base includes a projection that extends away from the second side of the support.

In still another form of the clip, the enclosure is a toilet bowl, and the first arm and the second arm are dimensioned to hang on a rim of the toilet bowl and support the base adjacent an inner wall of the toilet bowl.

In yet another form of the clip, the second section and the second segment contact an outer surface of the toilet bowl, and the first section and the first segment contact a top surface of the rim, and the support contacts an inner surface of the toilet bowl when the first arm and the second arm hang on the rim.

In still another form of the clip, the projection contacts an undersurface of the rim when the first arm and the second arm hang on the rim.

In yet another form of the clip, the base includes a barrel for supporting the fluid delivery device.

In still another form of the clip, the base comprises a fluid inlet, and the base supports a fluid delivery device comprising a nozzle in fluid communication with the fluid inlet.

In yet another form of the clip, the nozzle comprises a bottom wall, a passageway in fluid communication with the fluid inlet at an upper end of the passageway wherein the passageway extends between the fluid inlet and the bottom wall, a channel in fluid communication with a lower end of the passageway, and a pair of walls flanking the channel and extending upwardly from the bottom wall wherein the walls are contacted by fluid to rotate the nozzle.

In still another form of the clip, the base includes a shroud surrounding a portion of the nozzle.

In yet another form of the clip, the shroud has a transverse opening that provides a fluid path from the nozzle.

In yet another aspect, the invention provides a device for spraying an inner surface of an enclosure with a fluid. The device includes a container for the fluid; a fluid delivery device through which the fluid can be applied to the inner surface of the enclosure; a fluid conduit in fluid communication with the container and the fluid delivery device; means for delivering fluid from the container through the fluid conduit and to the fluid delivery device; and a clip for mounting the fluid delivery device adjacent a wall of the enclosure. The clip includes a support having a first side and an opposite second side, a base attached to the support wherein the base is structured for attaching the fluid delivery device to the base, a first arm having a first section extending laterally from the support and a second section extending downward from the first section, and a second arm having a first segment extending laterally from the support and a second segment extending downward from the first segment. The first arm and the second arm have an equilibrium position in which the first section and the first segment form a first angle facing away from the second side of the support. At least one of the first arm and the second arm can be elastically deflected to create a flexed position in which the first section and the first segment form a second angle facing away from the second side of the support. The second angle is less than the first angle.

In one form of the spraying device, the means for delivering fluid from the container comprises a propellant.

In another form of the spraying device, the enclosure is a toilet bowl, and the first arm and the second arm are dimensioned to hang on a rim of the toilet bowl and support the base adjacent an inner wall of the toilet bowl.

In yet another form of the spraying device, there is a sleeve for holding the fluid conduit adjacent the first arm.

It is therefore an advantage of the invention to provide a toilet bowl cleaning device where the inner surface of the toilet bowl is cleaned around the entire circumference of the toilet bowl. The device provides for overall toilet bowl cleanliness by enhanced shine and the retardation of biofilm, mold and/or mildew growth. The device can deliver liquids to remove or eliminate stains (hard water, limescale, metals, organic), mold, mildew, germs, odors, and bacteria. The device can spray the entire toilet bowl and is not limited to just one small area of the toilet bowl.

These and other features, aspects, and advantages of the present invention will become better understood upon consideration of the following detailed description and drawings.

BRIEF DESCRIPTION OF THE DRAWINGS

Like reference numerals will be used to refer to like parts from Figure to Figure in the following description of the drawings.

DETAILED DESCRIPTION OF THE INVENTION

The invention provides a device for spraying an inner surface of a toilet bowl with a chemical. Various embodiments of the invention will now be described with reference to the Figures. The embodiments are shown and described for the purposes of illustration and are not intended to limit the invention in any way.

Figure 1A:
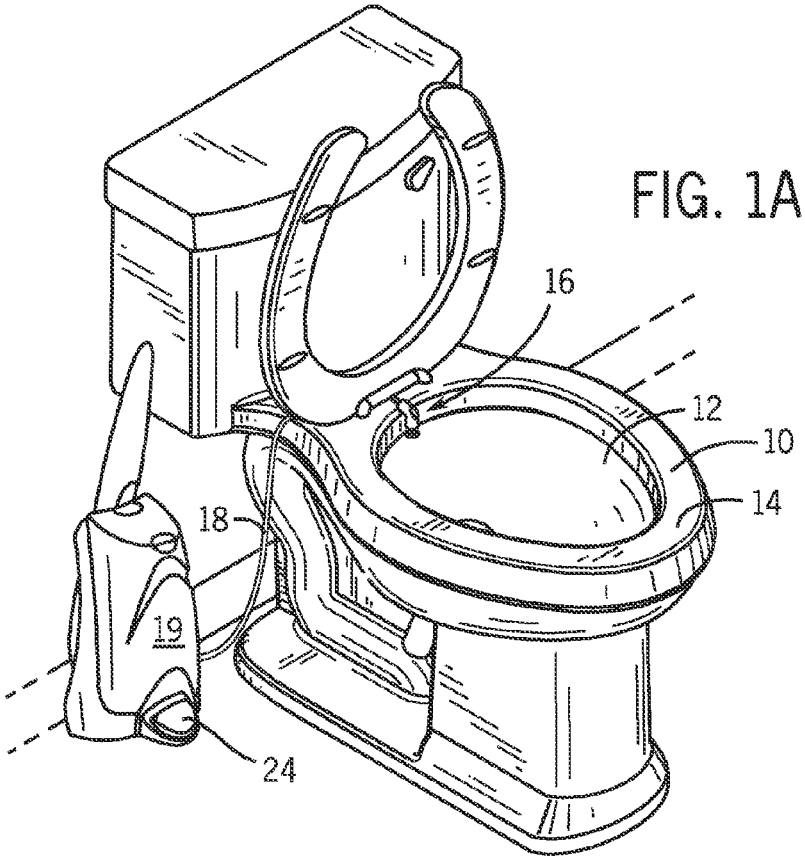
FIG. 1A is a perspective view of a prior art toilet bowl cleaning assembly.
Figure 1B:
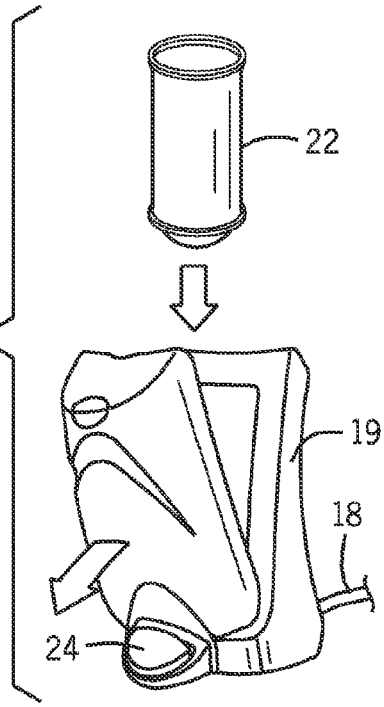
FIG. 1B is an enlarged, partially exploded view, of a prior art holder/activator used therewith.

FIGS. 1A and 1B show a prior art toilet 10, per FIGS. 11A-D of U.S. Pat. No. 7,603,726. Toilet 10 has a bowl 12 with a top rim 14. A spray nozzle 16 is hooked over the rim and fed a cleaner by a fluid conduit 18. The conduit 18 links to a holder 19 to which is mounted an aerosol container 22. Pressing down on a foot pedal 24 causes spraying of cleaner along the toilet bowl sides. This is a non-automated system that sprays for as long as the pedal is depressed. The fluid can also be supplied from the container 22 to the fluid sprayer by different types of powered or manual pumps.

Figure 2:
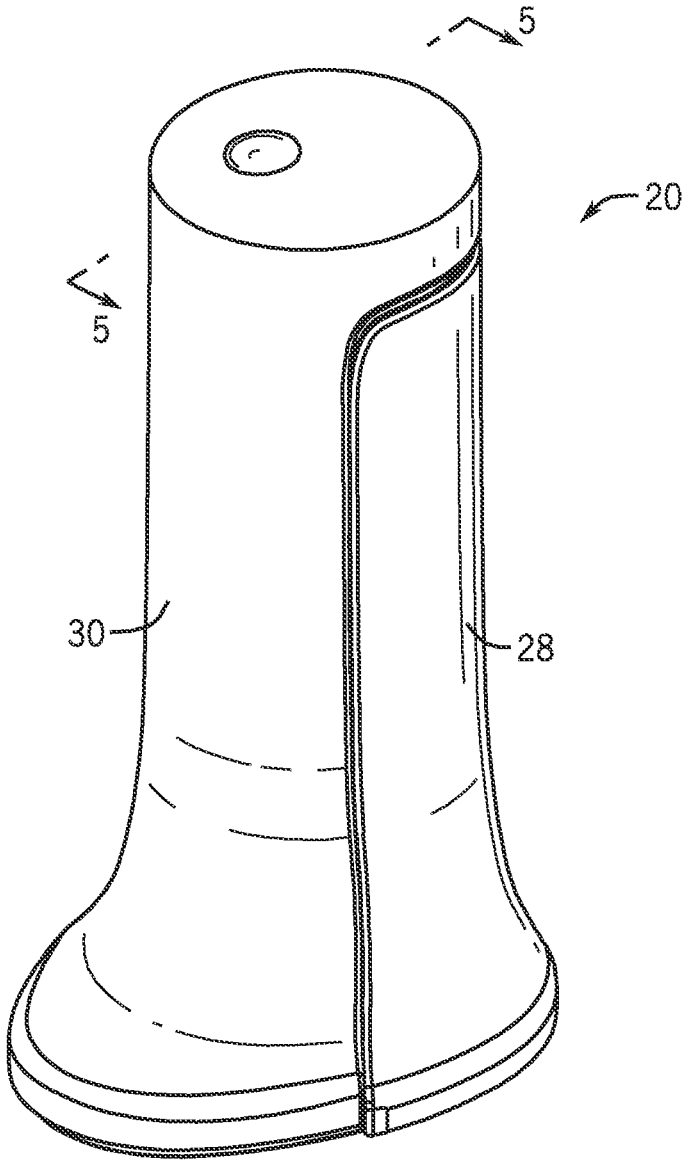
FIG. 2 is a perspective view of a holder in accordance with the invention.
Figure 3:
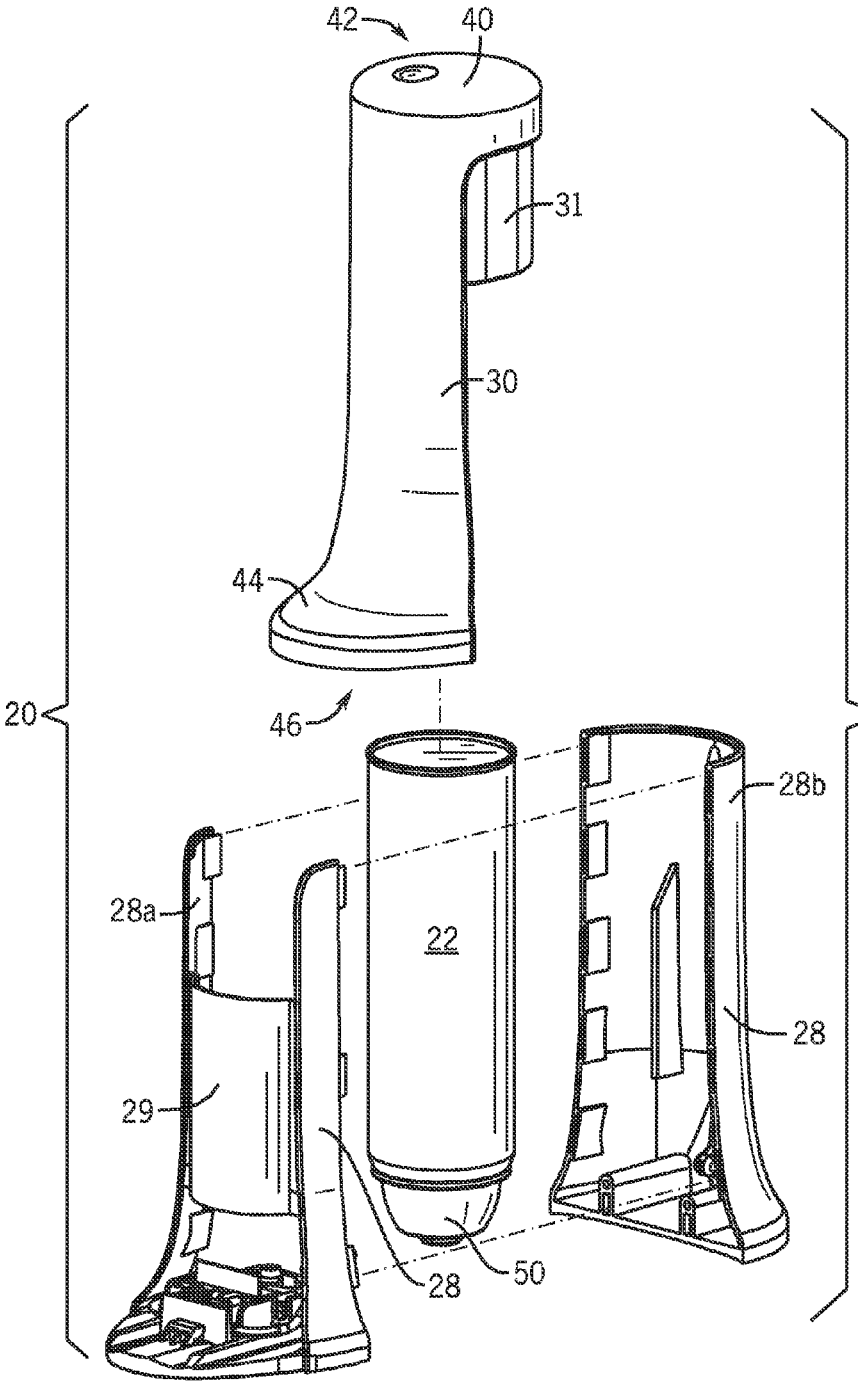
FIG. 3 is an exploded, perspective view of the holder from FIG. 2, depicting a container of fluid and retainer housed therein.
Figure 4:
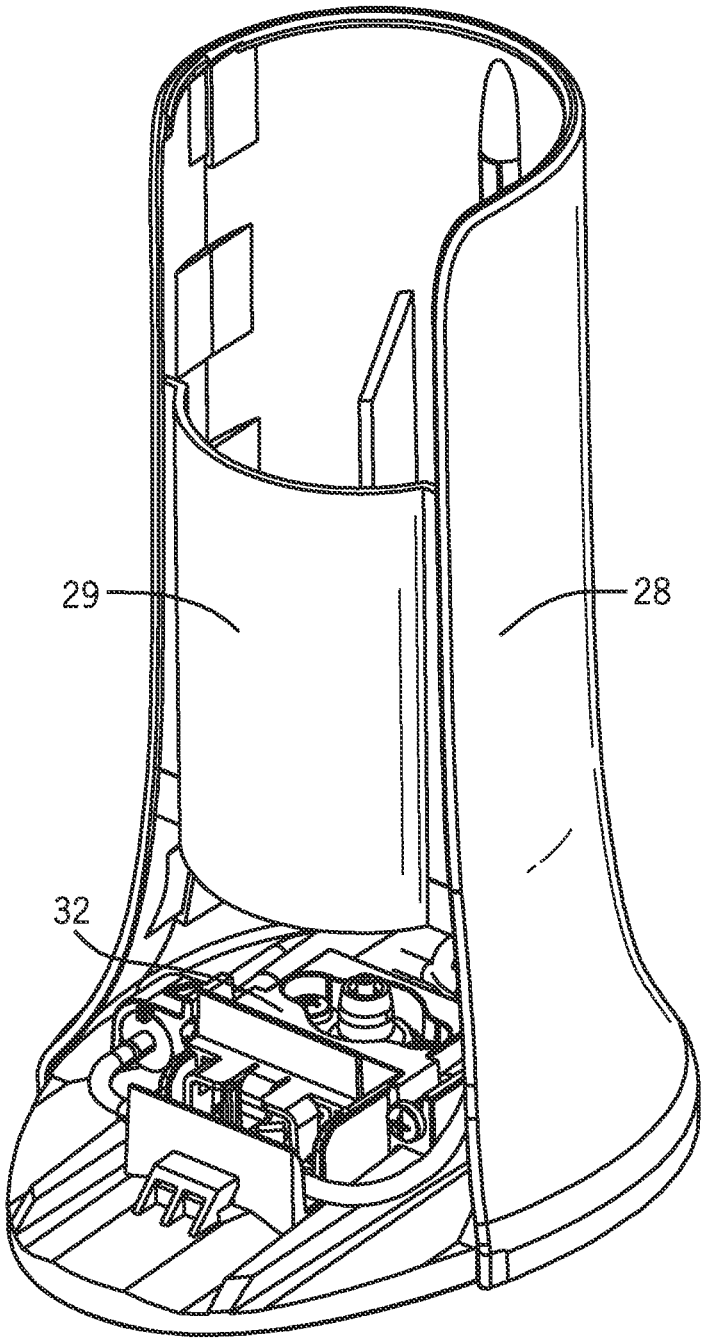
FIG. 4 is a perspective view of the base that forms part of the holder from FIG. 2.

Turning now to FIGS. 2-8, there is shown a holder 20 in accordance with the invention for delivering fluid to a conduit, such as fluid conduit 18 in FIG. 1A. As shown in FIG. 3, the holder 20 houses a container 22, which may be an aerosol container. The holder 20 includes a base 28 and a triggering device 30. The base 28 (as best shown in FIG. 4) includes a manifold 32.

Figure 6:
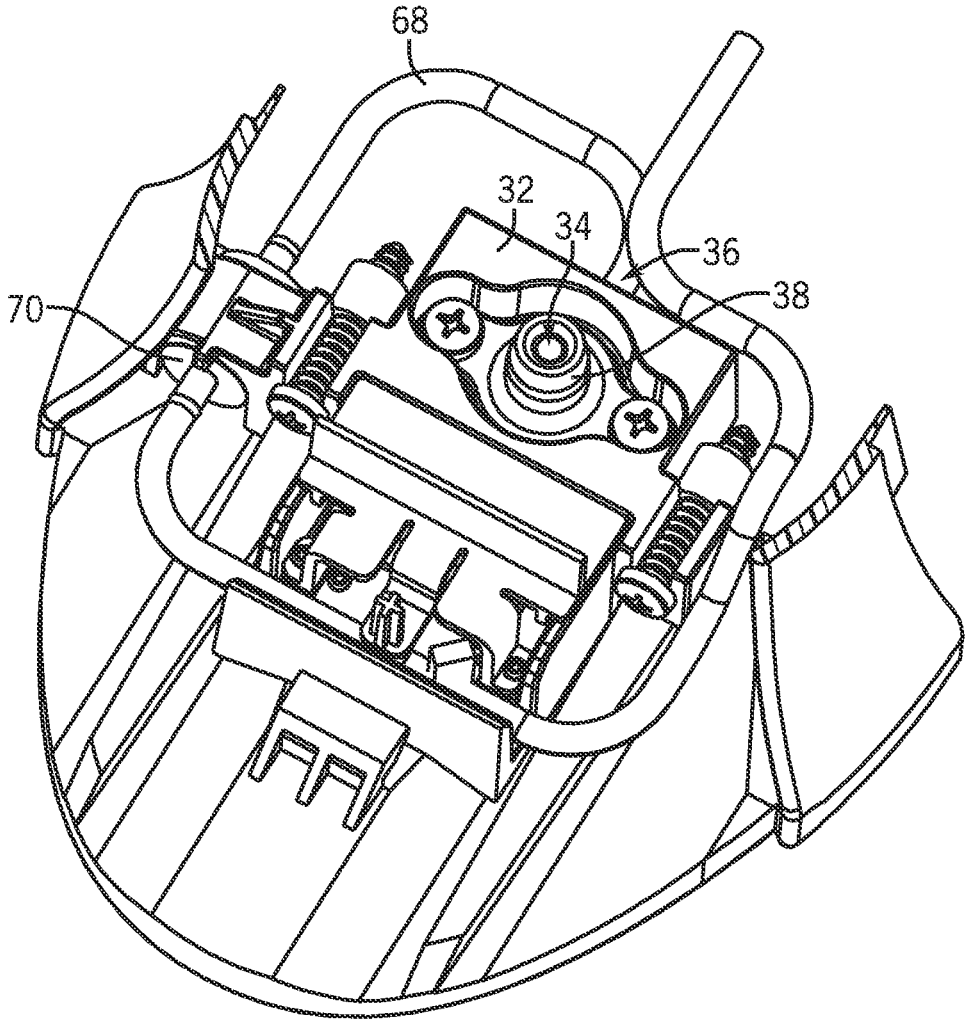
FIG. 6 is a perspective, detailed view showing a portion of the base, including the manifold and associated fluid delivery components, from FIG. 2.

As shown in FIGS. 3 and 4, the base 28 may be configured such that it is assembled from two parts: a front portion 28*a*, and a back portion 28*b*. The front portion 28*a* adjoins with the back portion 28*b* to form the base 28 as shown in FIG. 4. The base 28 may also contain a base wall 29, as shown in FIGS. 3 and 4. The manifold 32 is located near the bottom of the base 28. As depicted in FIG. 6, the manifold 32 includes an inlet 34, an outlet 36, and a fitment 38. The inlet 34 is in fluid communication with the outlet 36.

As shown in FIG. 3, the triggering device 30 includes a first flange 40 that is located on one end 42 of the triggering device 30 and a second flange 44 that is located on an opposite end 46 of the triggering device 30. The first flange 40 extends from the triggering device 30 in an opposite direction from the direction in which the second flange 44 extends. Furthermore, the first flange 40 forms a top portion of the holder 20. Similar to the base wall 29 described above, the triggering device 30 may include a triggering device wall 31.

Figure 7:
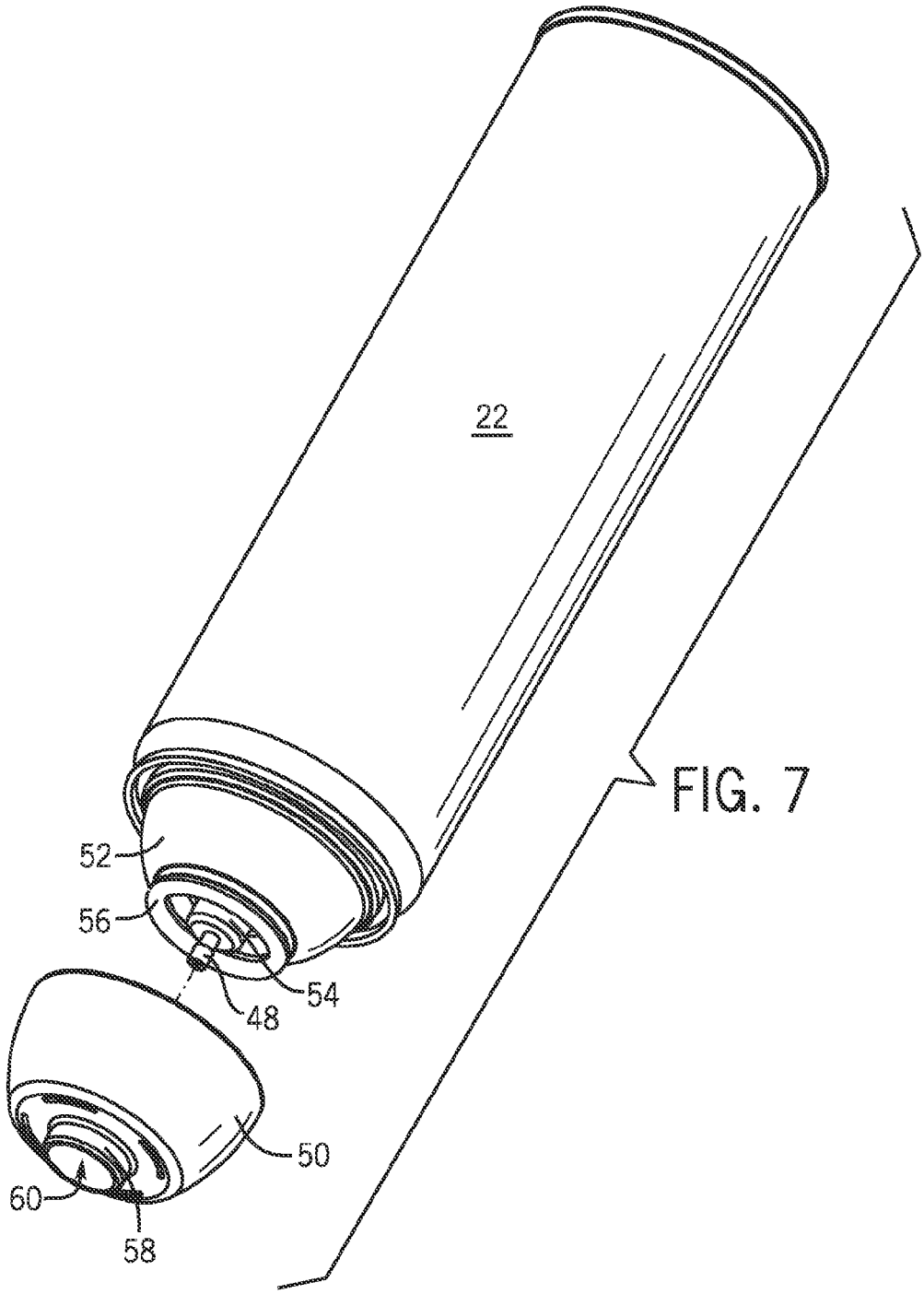
FIG. 7 is an exploded, perspective view of a refill in accordance with the invention.
Figure 8:
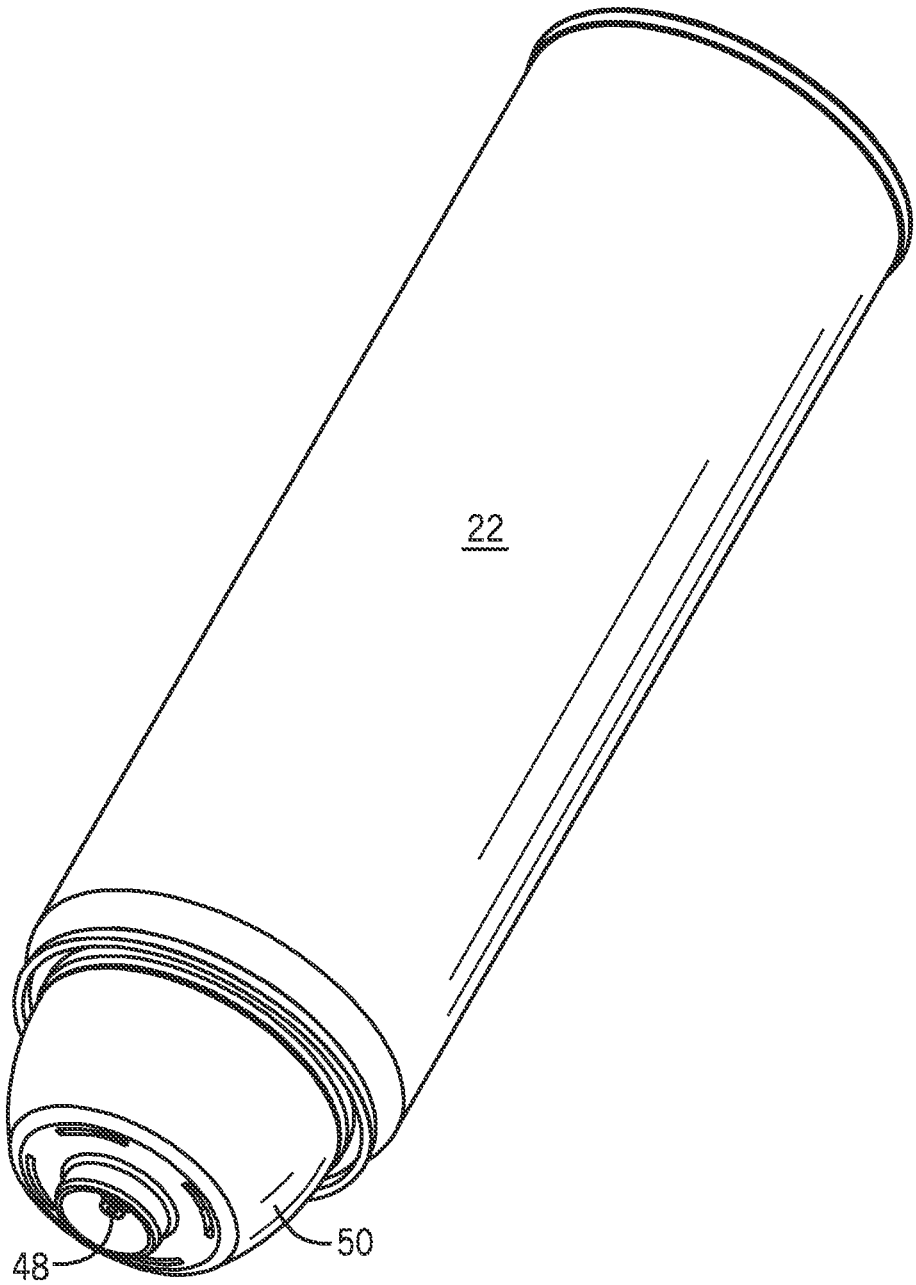
FIG. 8 is a perspective view of the assembled refill from FIG. 7.
Figure 9:
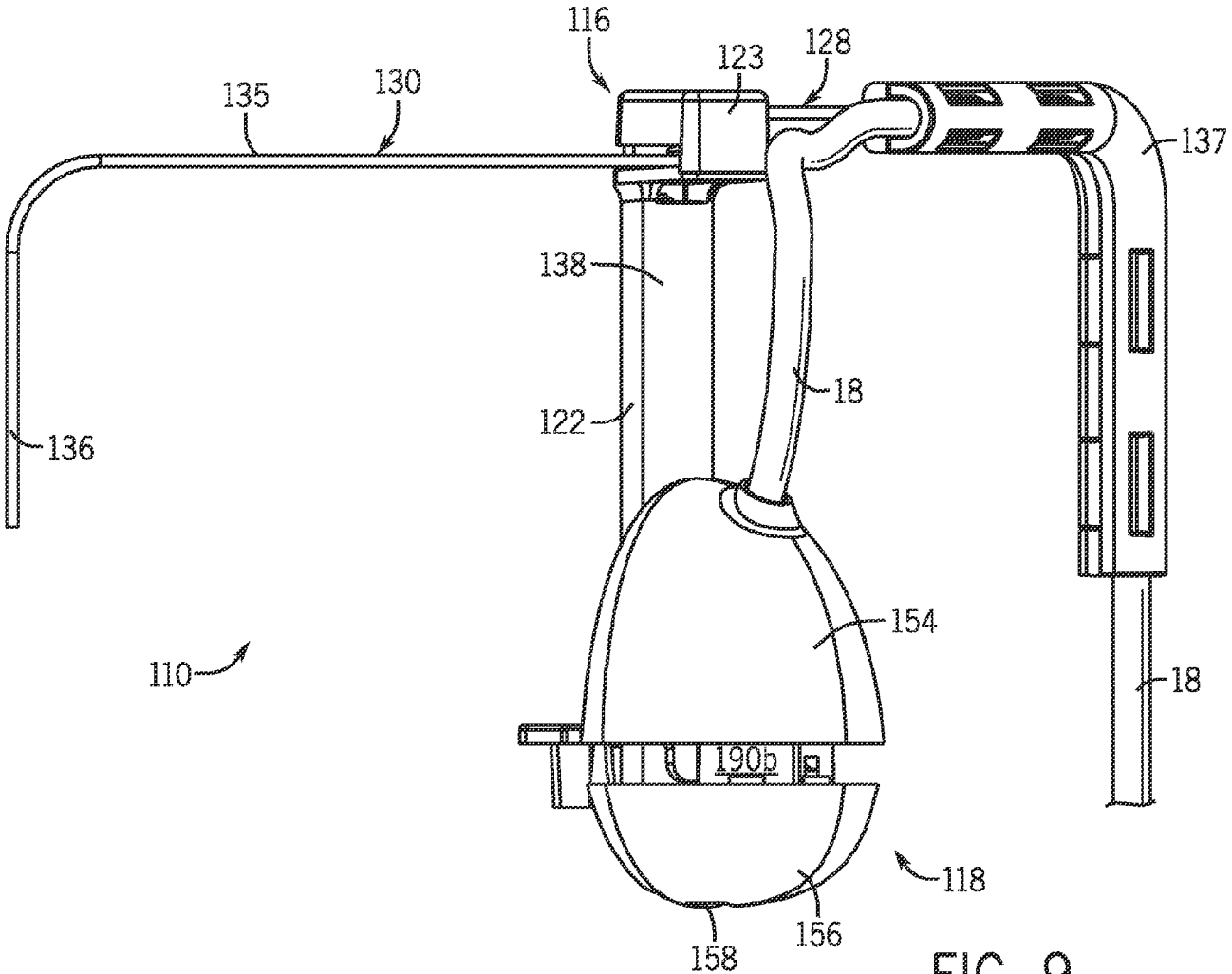
FIG. 9 is a top, left perspective view of a clip for mounting a fluid delivery device in accordance with one embodiment of the invention.
Figure 10:
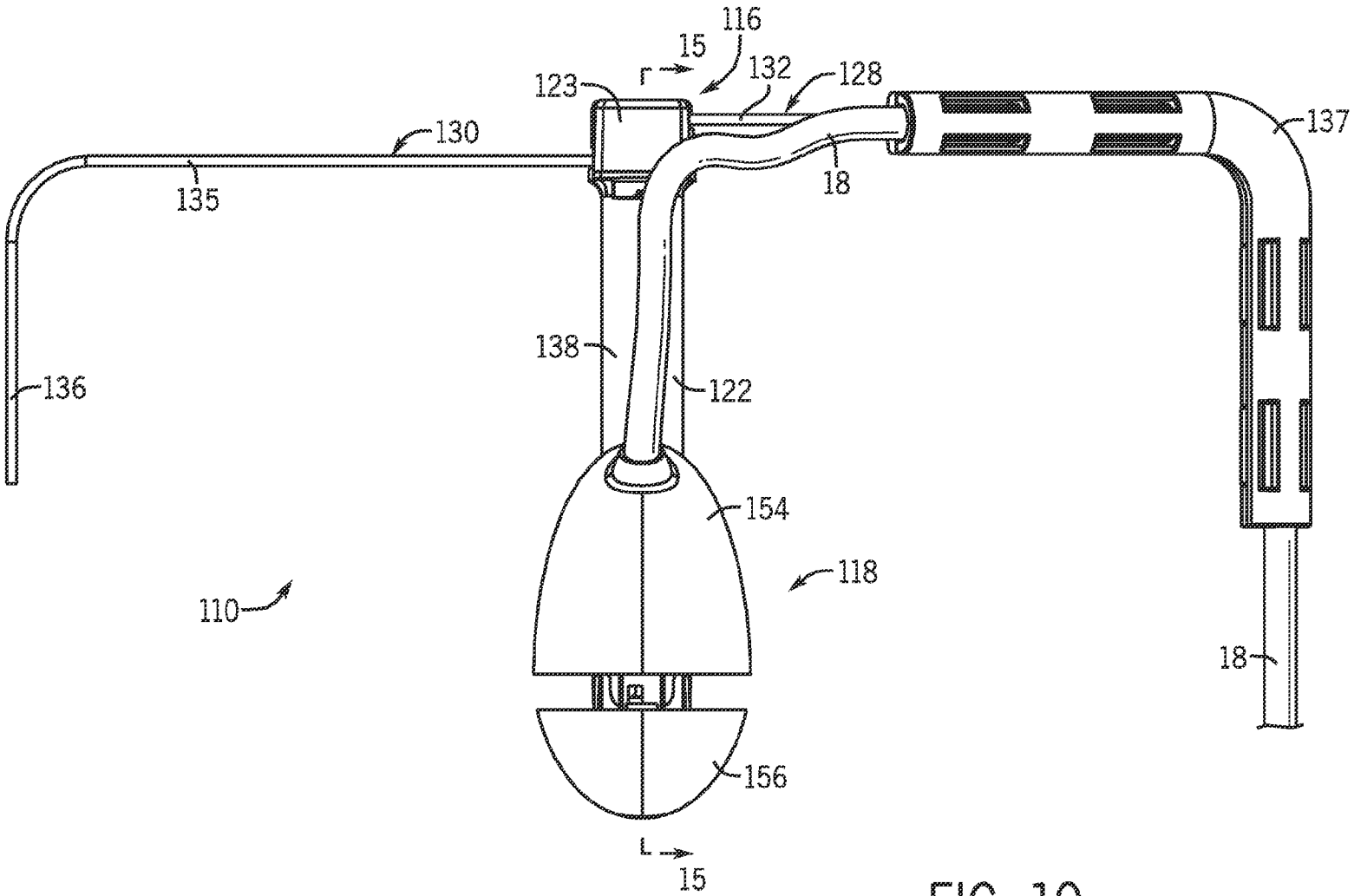
FIG. 10 is a front elevational view of the clip of FIG. 9.
Figure 11:
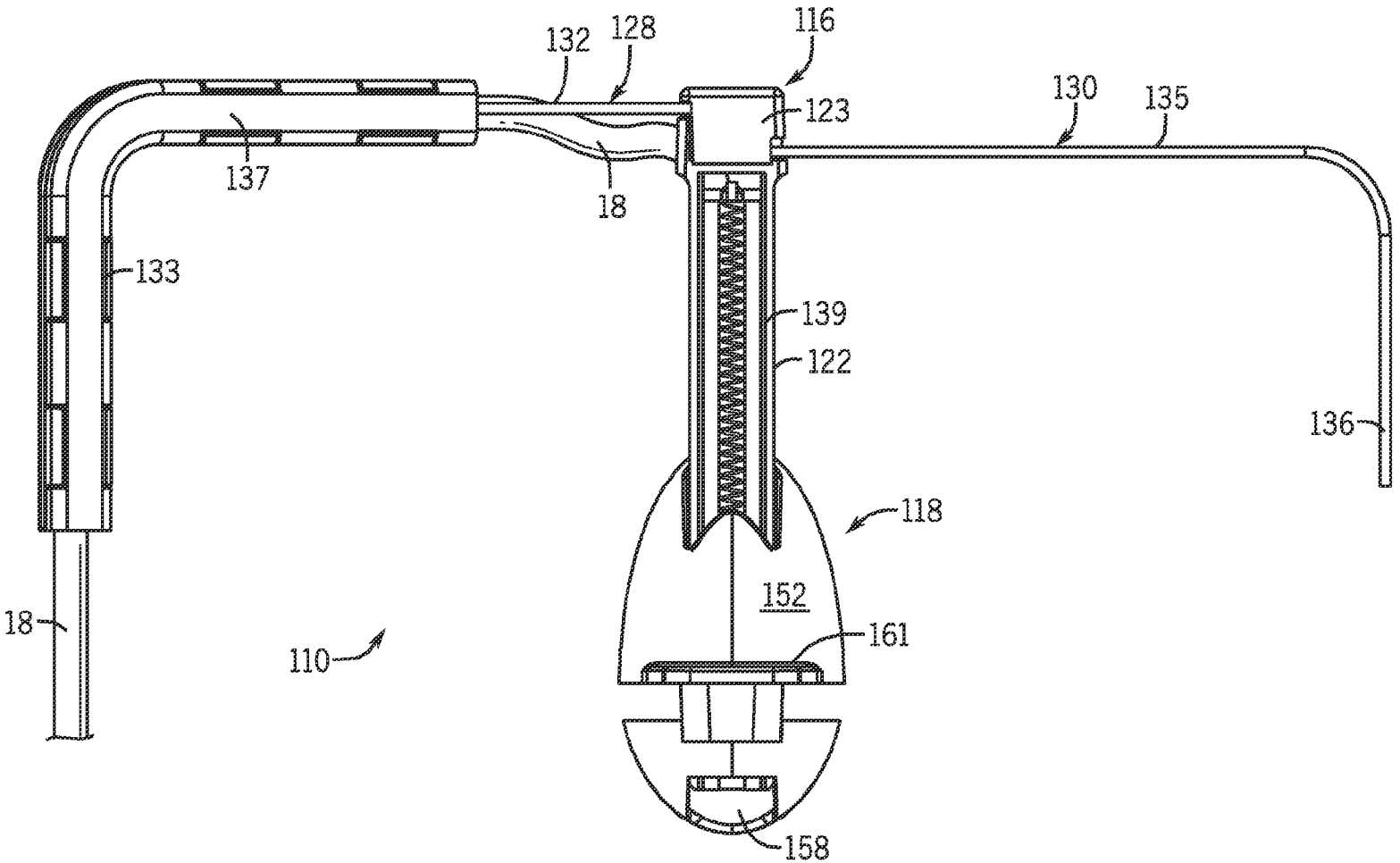
FIG. 11 is a rear elevational view of the clip of FIG. 9.
Figure 12:
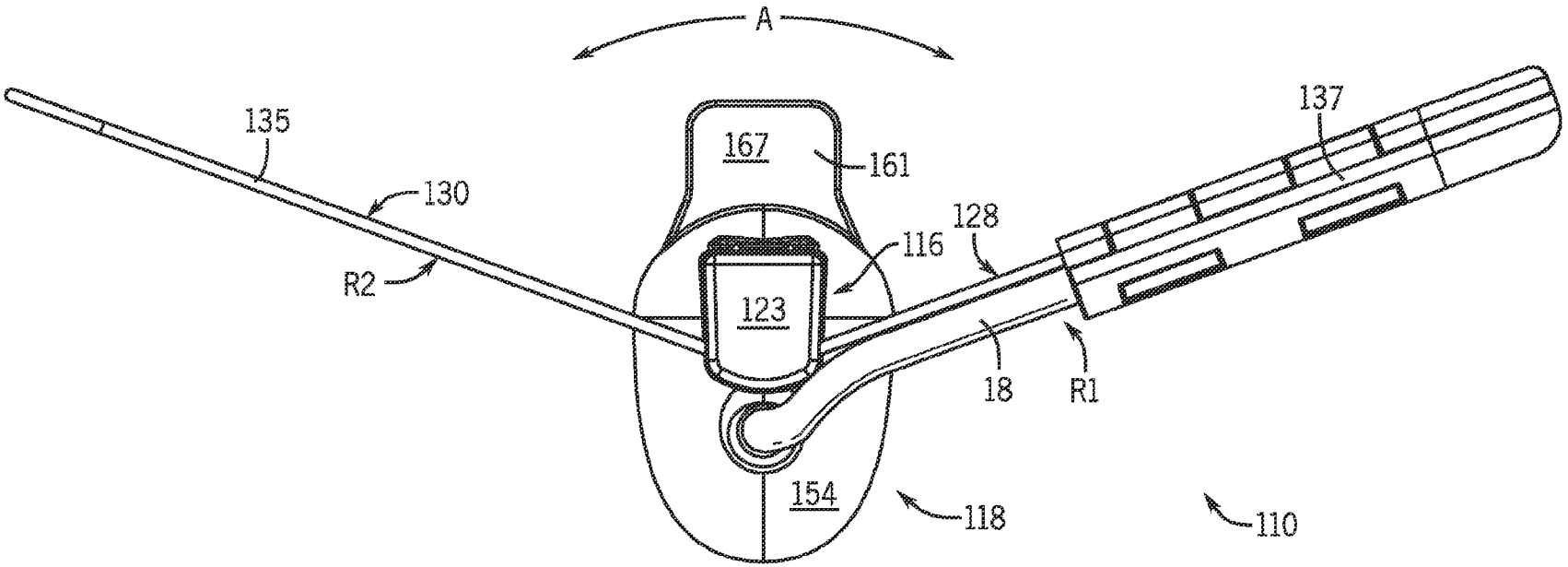
FIG. 12 is a top plan view of the clip of FIG. 9.

The container 22 is housed within the holder 20 by a retention mechanism. The container 22 may be an aerosol container with a valve stem 48, as shown in FIG. 7. The container 22 is assembled with a retainer 50 before housing the container 22 in the holder 20. As shown in FIGS. 7 and 8, the retainer 50 is assembled with the container 22 by placing the retainer 50 over the dome 52 of the container 22. The container 22 also has a pedestal 54, which surrounds the valve stem 48, as well as a valve cup rim 56.

The retainer 50 includes a projection 58 that extends outwardly from the retainer 50. A cavity 60 is formed on the interior of the projection 58. As shown from FIG. 3, the container 22 and retainer 50 will be housed in the holder 20 such that the container 22 is oriented with the retainer 50 facing the bottom of the base 28, where the manifold 32 is located.

Figure 5:
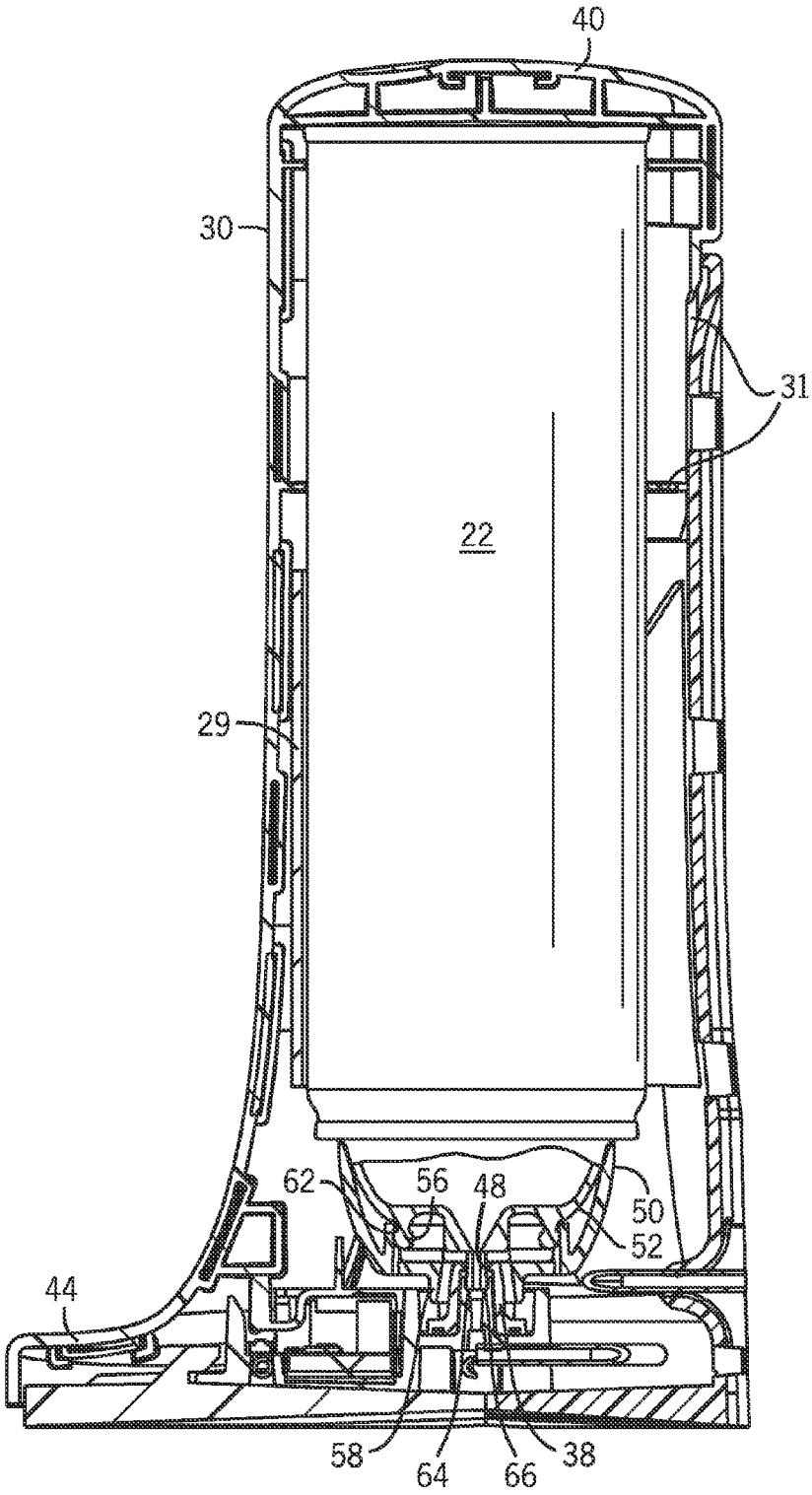
FIG. 5 is a cross-sectional view of the holder of FIG. 2 along line 5-5.

Turning now to FIG. 5, a cross-sectional view of the holder 20 housing the container 22 is shown. In addition to the retainer 50 engaging a portion of the dome 52 of the container 22, the retainer 50 includes a central annular wall 62 that is dimensioned to engage the valve cup rim 56 of the container 22. As the container 22 and retainer 50 are assembled to the holder 20, the fitment 38 is received within the cavity 60 of the projection 58. The retention mechanism thus includes the engagement between the container 22 and the retainer 50, and the engagement between retainer 50 and fitment 38. As shown in FIGS. 4-8, the cavity 60 and the fitment 38 have corresponding shapes such that the fitment 38 may be received in the cavity 60. Although the cavity 60 and fitment 38 are shown as having corresponding cylindrical shapes, it can be appreciated that the cavity and fitment 38 could be of other corresponding shapes. The valve stem 48 of the container 22 is received within the fitment 38. The retention mechanism may also include the base wall 29 and the triggering device wall 31 as the walls 29, 31 may also help to retain and position the container 22 within the holder 20.

After assembling the container 22 and retainer 50 within the holder 20, the holder 20 may be used as part of a device 26 for spraying an inner surface 12 of a wall of an enclosure 10 with a fluid, as described in the prior art and as shown in FIGS.

1A and 1B. The container 22 and retainer 50 are placed within holder 20, as just described, and holder 20 may be substituted for the holder 19 of the prior art in FIGS. 1A and 1B. As previously described, also forming part of the device 26 is a fluid conduit 18, a sprayer 16, and means for attaching the fluid sprayer 16 near the inner surface 12 of the wall of the enclosure 10. As shown in FIG. 1A, the enclosure 10 is a toilet.

Referring back to FIGS. 2-6, the interaction between components of the holder 20 and the container 22 will now be described such that fluid is allowed to be delivered from the container 22, through the manifold 32, through the fluid conduit 18, to the fluid sprayer 16, and on the toilet bowl 12. The triggering device 30 is configured to move between a first position and a second position upon a force applied to either the first flange 40 or the second flange 44 by a user. Advantageously, a user may apply the force to either flange 40, 44 to engage the container 22. Thus, the user may use either their hand or foot to engage the first flange or the second flange, as they so desire. This may vary based on user preference, the position the user is in when the user desires to apply fluid to the enclosure 10, or other factors.

In FIG. 2, the holder 20 is shown with the triggering device 30 in the first position. In the first position, the valve stem 48 of the container 22 is not engaged, and thus, fluid does not exit the container 22. However, upon pressure being supplied to the first flange 40 or the second flange 44, the triggering device 30 will move and engage the container 22. As the triggering device 30 is moved in a downward direction, the first flange 40 contacts the container 22, moving the container 22 downward toward the manifold 32 on the base 28 of the holder 20. As the container 22 moves downward, the triggering device wall 31 slides between the container 22 and the base 28. The container 22 also moves relative to the base wall 29. The valve stem 48 of the container 22, however, is unable to move in a downward direction with the container 22 because the tip 64 of the valve stem 48 engages the narrowed inner surface 66 of the fitment 38. Thus, the fitment 38 moves the valve stem 48 relative to the container 22 to supply the fluid to the inlet 34 of the manifold 32.

Turning now to FIG. 6, after fluid is supplied to the inlet 34, the fluid may flow to the outlet 36 of the manifold 32. Before entering the conduit 18 and fluid sprayer 16, the fluid may travel through internal conduit 68 and a check valve 70 located within the holder 20. The internal conduit 68 is in fluid communication with the outlet 36 of the manifold 32 and the fluid conduit 18. After the user removes pressure from either the first flange 40 or the second flange 44, the triggering device 30 will return to the first position. The user may repeat the process to provide more fluid to toilet bowl 12.

Advantageously, the check valve 70 may be used as a way to prime the device 26 such that fluid will be maintained downstream of the check valve 70 after fluid has entered the conduit 18 from an initial use of the device 26. This will prevent a user from having to supply pressure to the triggering device 30 to move the triggering device 30 from the first position to the second position multiple times before delivering fluid to the toilet bowl 12.

Once the fluid is completely used from the container 22, the container 22 and the retainer may be replaced in the holder 20. Accordingly, the container 22 and retainer 50, as shown in FIG. 8, may be referred to as a "refill."

Turning now to FIGS. 9-15, there is shown an example embodiment of a clip 110 for mounting a fluid delivery device (e.g. a sprayer) to an enclosure such as a toilet bowl. The clip 110 is secured to the rim 14 of the toilet bowl 12 by an adjustable mounting mechanism 116. A base 118 is supported by the mounting mechanism 116 and supports a fluid delivery device, here a nozzle 120. A container supplies fluid via a fluid conduit 18 to the fluid delivery device 120 to be dispensed onto the inside surface of the toilet bowl in the manner of the spray nozzle 16 of FIGS. 1A-1B. The fluid can be supplied from the container to the fluid delivery device 120 in a variety of ways; for example, the fluid may be motivated by a gaseous propellant, by a manual or electric pump, a syringe, or any other suitable means. Furthermore, the execution of the fluid delivery from the container can be controlled by a variety of methods/devices, one being a timing circuit using predetermined logic to control when the fluid is dispensed.

The mounting mechanism 116 for supporting the base 118 and attaching the clip 110 to the toilet bowl 12 includes a vertical support 122 with a top casing 123 having a pin 124 surrounded by a closed coil section 125 of a helical torsion spring 126 (see FIG. 15) which has a first arm 128 and a second arm 130. The first arm 128 has first section 132 extending laterally from the closed coil section 125 and a second section 133 extending downward from the first section 132. The second arm 130 has a first segment 135 extending laterally from the closed coil section 125 and a second segment 136 extending downward from the first segment 135. An elastic sleeve 137 holds the fluid conduit 18 adjacent the first arm 128 as it is routed on its way to the nozzle 120 in the base 118. The support 122 is preferably molded from a polymeric material (e.g., polyethylene or polypropylene). The helical torsion spring 126 can be formed from a suitable spring material such as stainless steel.

The support 122 has a first side 138 and an opposite second side 139. When the helical torsion spring 126 is in a relaxed undeflected position, the first arm 128 and the second arm 130 have an equilibrium position in which the first section 132 and the first segment 135 form a first angle A (see FIG. 12) facing away from the second side 139 of the support 122. A user can apply a force in direction R1 on the first arm 128 and/or apply a force in direction R2 on the second arm 130 to create a flexed position in which the first section 132 and the first segment 135 form a second angle facing away from the second side 139 of the support 122. As a result, the second angle is less than the first angle. This creates a larger distance between the second section 133 and the second side 139 of the support 122 and also creates a larger distance between the second segment 136 and the second side 139 of the support 122 when mounting the clip 110 to the toilet bowl 12.

Figure 13:
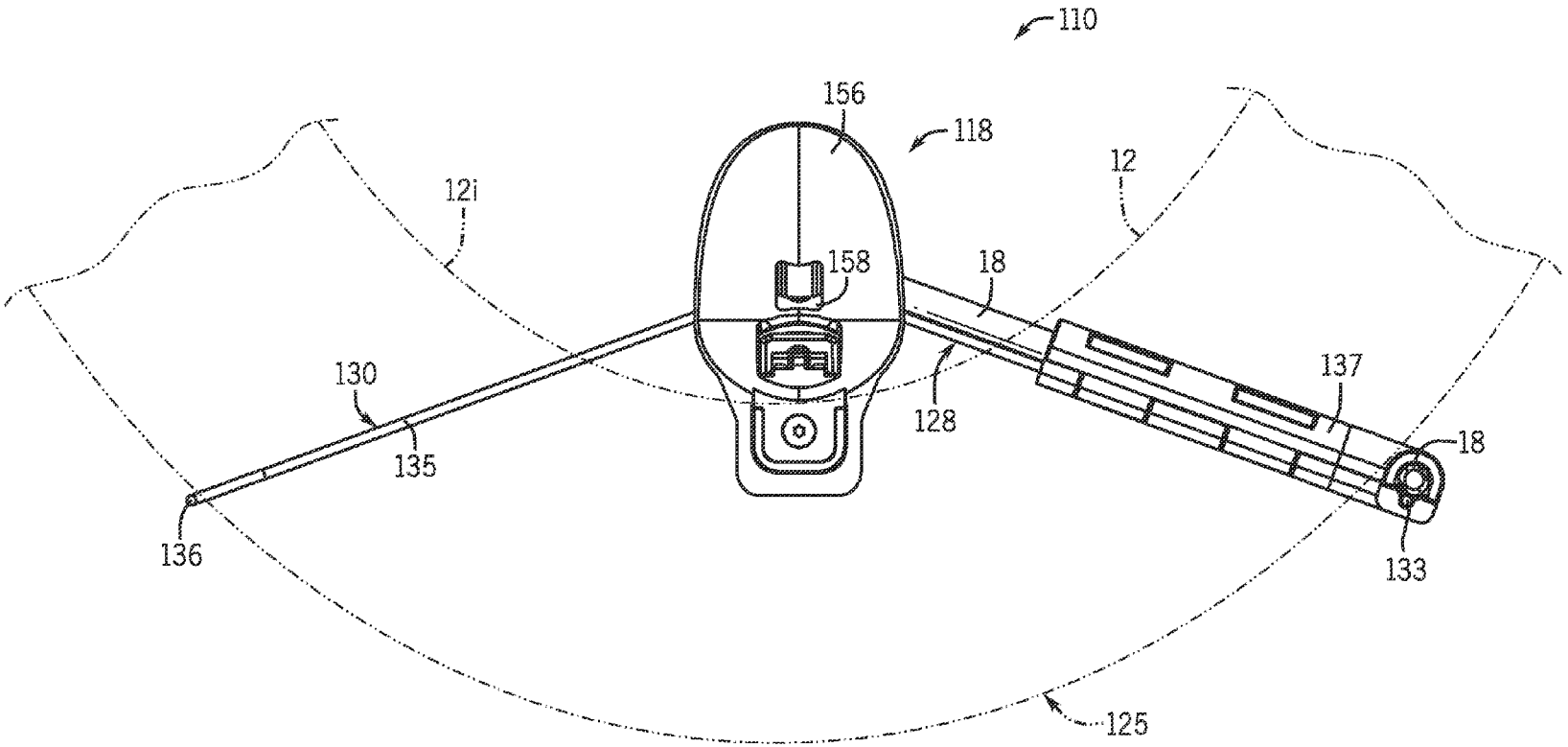
FIG. 13 is a bottom plan view of the clip of FIG. 9.
Figure 14:
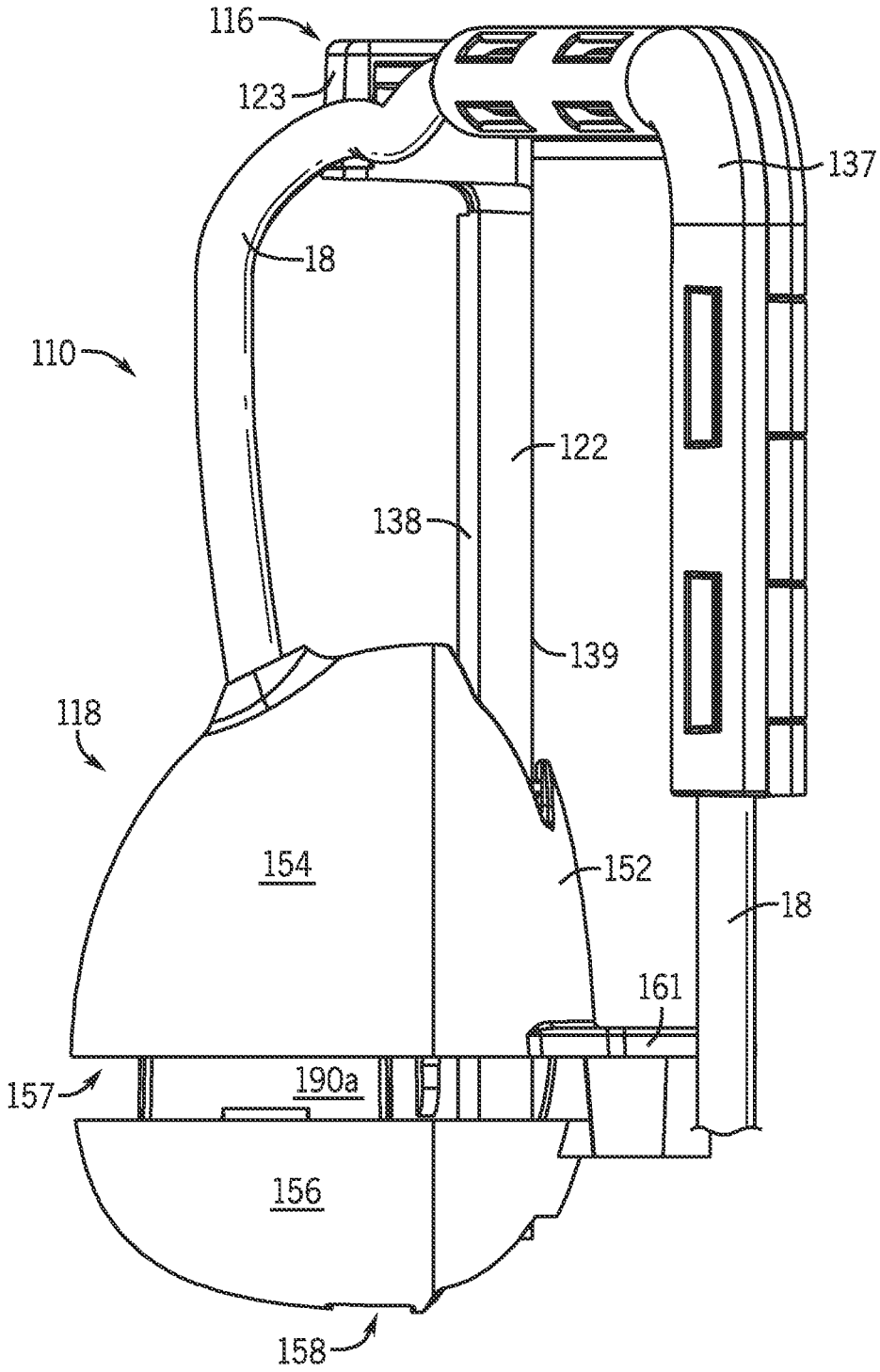
FIG. 14 is a right side elevational view of the clip of FIG. 9.

As shown in FIG. 13, when the clip 110 has been mounted to the toilet bowl 12 (shown dashed lines in FIG. 13), the second section 133 and/or the sleeve 137 and the second segment 136 contact an outer surface 12*s* of the toilet bowl 12, and the first section 132 and the first segment 135 contact a top surface of the rim 14 of the toilet bowl 12, and the second side 139 of the support 122 contacts an inner surface 12*i* of the toilet bowl 12 as the first arm 128 and the second arm 130 hang on the rim 14. The spring force provided by the helical torsion spring 126 on the first section 132 and the first segment 135 keeps the second section 133 and the second segment 136 in contact with the outer surface 12*s* of the toilet bowl 12 and the second side 139 of the support 122 in contact with the inner surface 12*i* of the toilet bowl 12 thereby trapping the mounting mechanism 116 to the toilet bowl 12.

The base 118 of the clip has a back face 152, a top front face 154, and a bottom front face 156 that form a hollow shroud around the nozzle 120. A transverse opening 157 is formed between the top front face 154 and the bottom front face 156. A drain opening 158 is provided in the bottom of the bottom front face 156 for draining away fluid that may accumulate inside the shroud. The base 118 is preferably molded from plastic (e.g., polyethylene or polypropylene).

Figure 15:
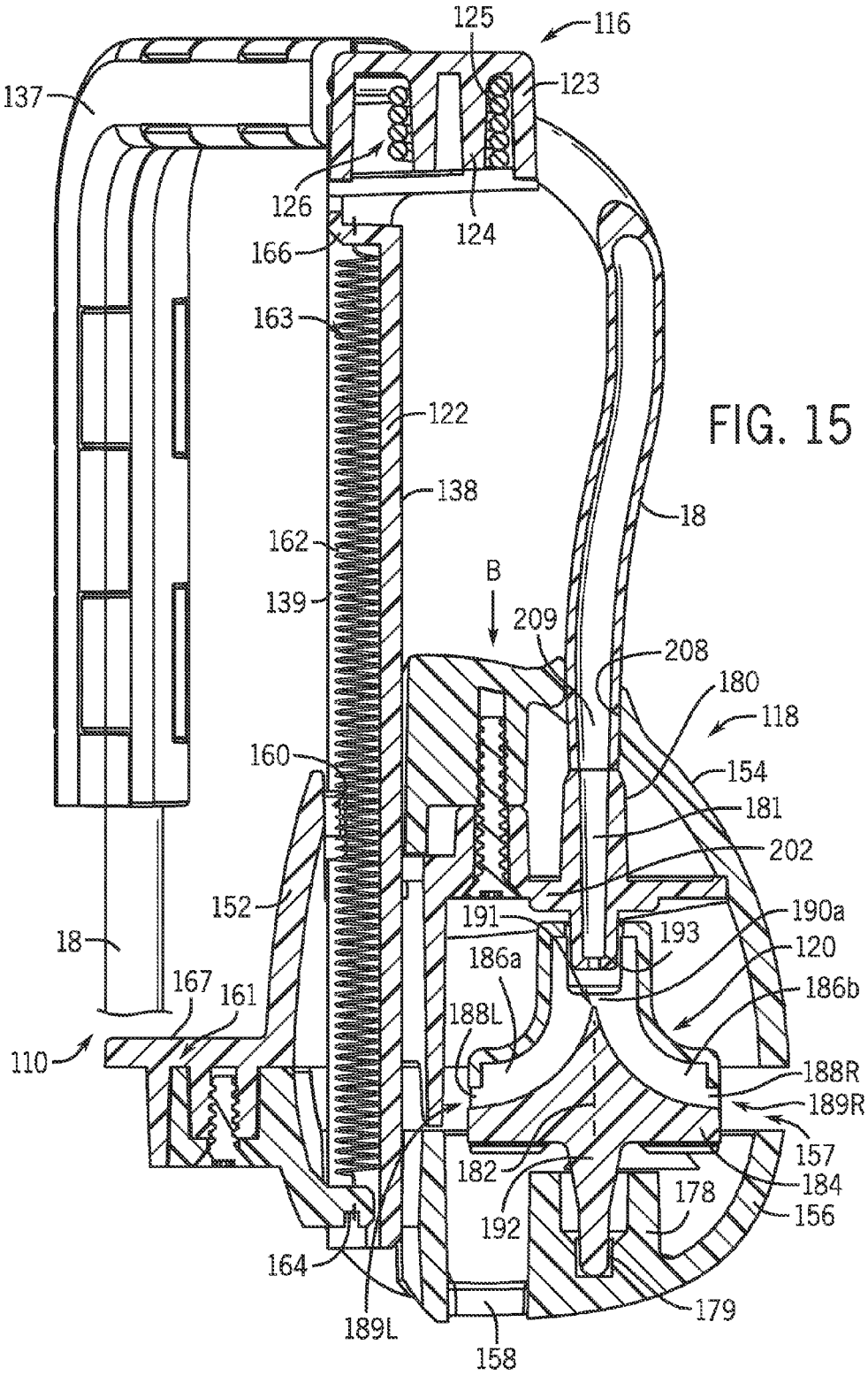
FIG. 15 is a cross-sectional view of the clip of FIG. 9 taken along line 15-15 of FIG. 10.

Looking at FIG. 15, the base 118 includes a tab 160 that extends inward from the back face 152 and a plate 161 that projects outward from the back face 152. The tab 160 is dimensioned to slide within a channel 162 of the support 122. An extension spring 163 is attached to an inwardly directed mounting hook 164 of back face 152 of the base 118 and also attached to a mounting hook 166 of the support 122.

A user can apply a force in direction B (see FIG. 15) on the base 118 to move the top casing 123 away from the base 118. This creates a larger distance between the top casing 123 and the base 118 when mounting the clip 110 to the toilet bowl 12. When the clip 110 has been mounted to the toilet bowl 12, the spring 163 biases the top casing 123 toward the base 118 such that the first section 132 and the first segment 135 grip the top rim 14 of the toilet bowl 12, and a top surface 167 of the plate 161 grips an undersurface of the toilet bowl 12.

The base 118 includes a means to attach a fluid delivery device (e.g., nozzle 120) to the base 118. In the example embodiment, the nozzle 120 is restrained laterally between a barrel 178 and a fluid inlet 180. The fluid inlet 180 and the barrel 178 are used in conjunction to restrain lateral movement of the nozzle 120, but allow the nozzle 120 to rotate about the nozzle axis 182. The tubular fluid inlet 180 defines a flow path 181, and extends downwardly from a wall 202 that is attached to the base 118. The base 118 includes a fluid supply opening 208 that defines a flow path 209. The fluid supply opening 208 is located in the top front face 154 of the base 118, and may be connected to fluid conduit 18 (see FIG. 15).

Referring to FIG. 15, the inner flow paths of the nozzle 120 are shown in greater detail. The nozzle 120 is preferably molded from polymeric material (e.g., polyethylene and polypropylene). The nozzle 120 includes a bottom wall 184. An axial spindle 192 extends downward from the bottom wall 184. Spaced apart walls 190*a*, 190*b*, which have a generally inverted T-shape, extend upward from the bottom wall 184. A central fluid deflection peak 191 extends upward from the bottom wall 184 between the walls 190*a*, 190*b*. Passageways 186*a*, 186*b* are defined by the walls 190*a*, 190*b* and the peak 191, and the passageways 186*a*, 186*b* extend upwards from the bottom wall 184. The contour of the walls 190*a*,190*b* may vary depending on the desired rotational speed of the nozzle 120, the pressure of the fluid, the flow rate of the fluid, and the like.

As shown in FIG. 15, the nozzle 120 is restrained laterally by inserting a spindle 192 into a recess 179 in the barrel 178 and by inserting the end of the fluid inlet 180 in depression 193. The nozzle 120 is free to rotate about the nozzle axis 182, but is restrained from lateral movement.

In operation, fluid is moved from a container through a fluid conduit (see, for example, the container 22 and the conduit 18 of FIG. 1A) and into the fluid supply opening 208. Looking at FIG. 15, the fluid flows through the flow paths 209 and 181, and out of the fluid inlet 180. (The diameter of the exit orifice of the fluid inlet 180 can dictate the pressure which helps to dictate the spin rate and the distance of fluid travel off the nozzle 120.) Fluid flows onto the top of the fluid deflection peak 191 and down the forked passageways 186 where it is directed radially outward by channels 188L, 188R. As the fluid exits the channels 188L, 188R, the fluid path is altered by the angled inner surfaces flanking the channels 188L, 188R. The reaction causes the nozzle 120 to rotate. As a result, the fluid is expelled radially outward from fluid outlets 189L, 189R of the nozzle 120, through the transverse opening 157, and onto the inside surface of the enclosure such as the inner wall surface of a toilet bowl.

Figure 16:
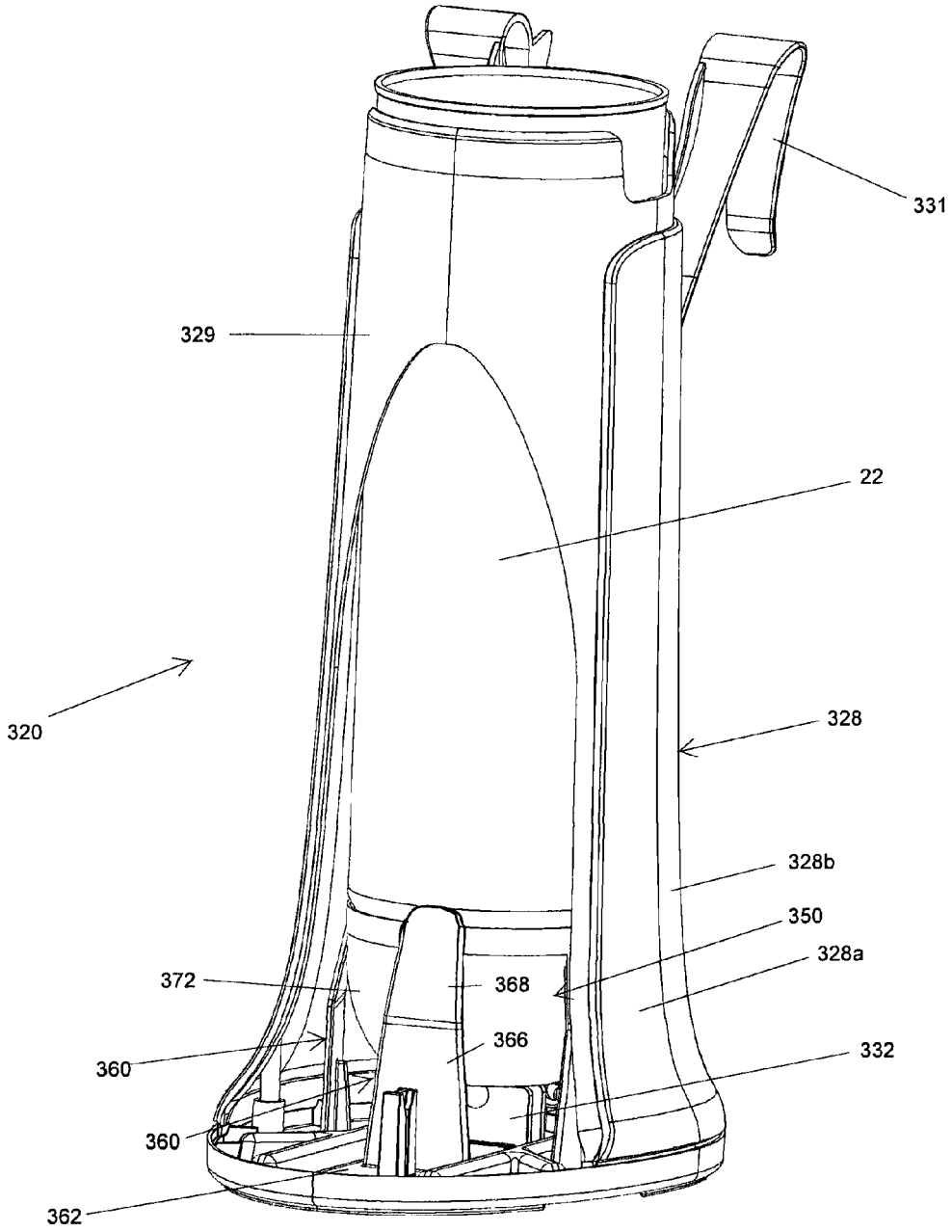
FIG. 16 is a perspective view of a second embodiment of a holder in accordance with the invention, the triggering device of the holder being removed to show inner details of the holder.
Figure 17:
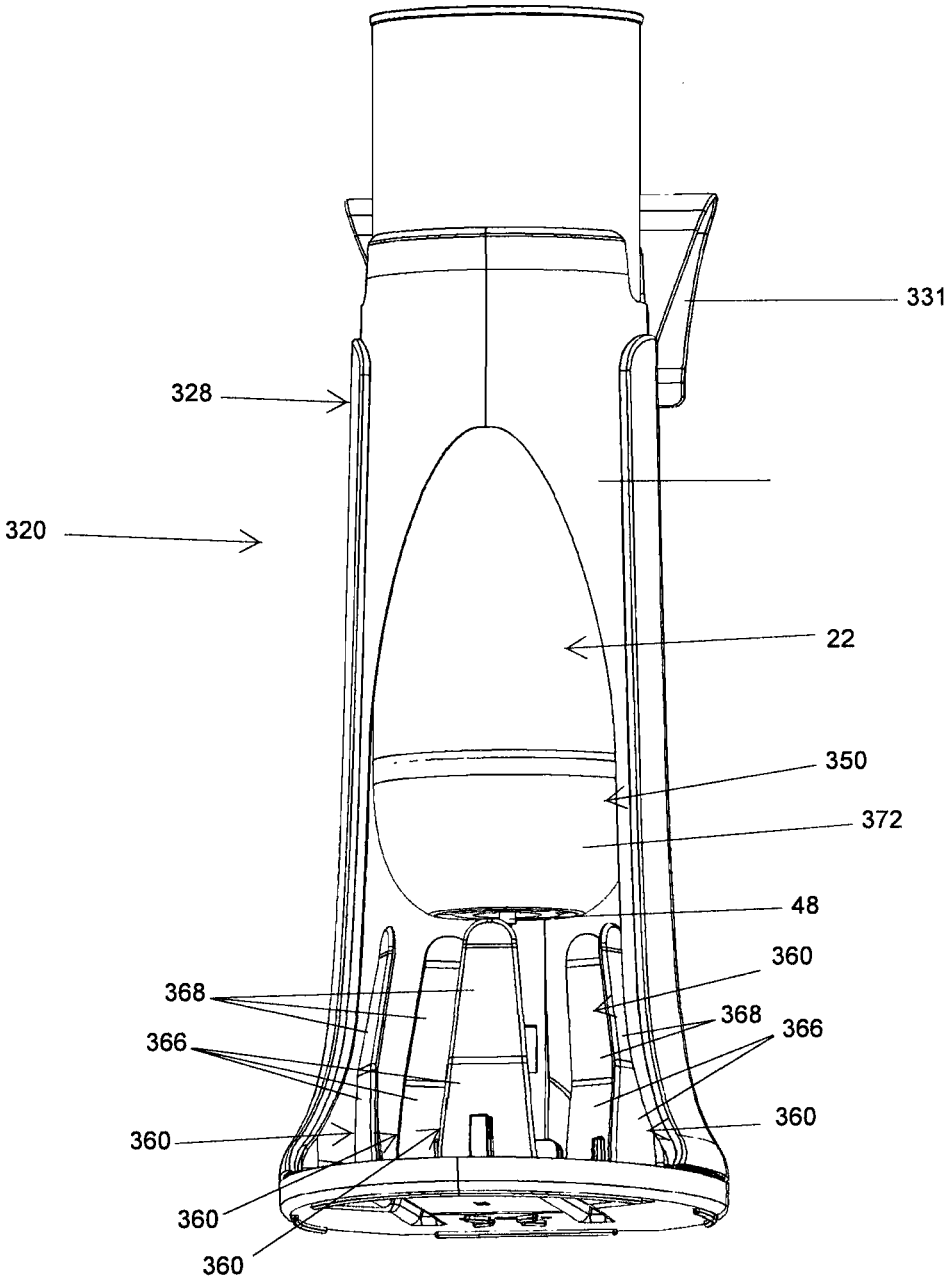
FIG. 17 is a perspective view of the holder of FIG. 16 during installation of another embodiment of a refill in accordance with the invention.
Figure 18:
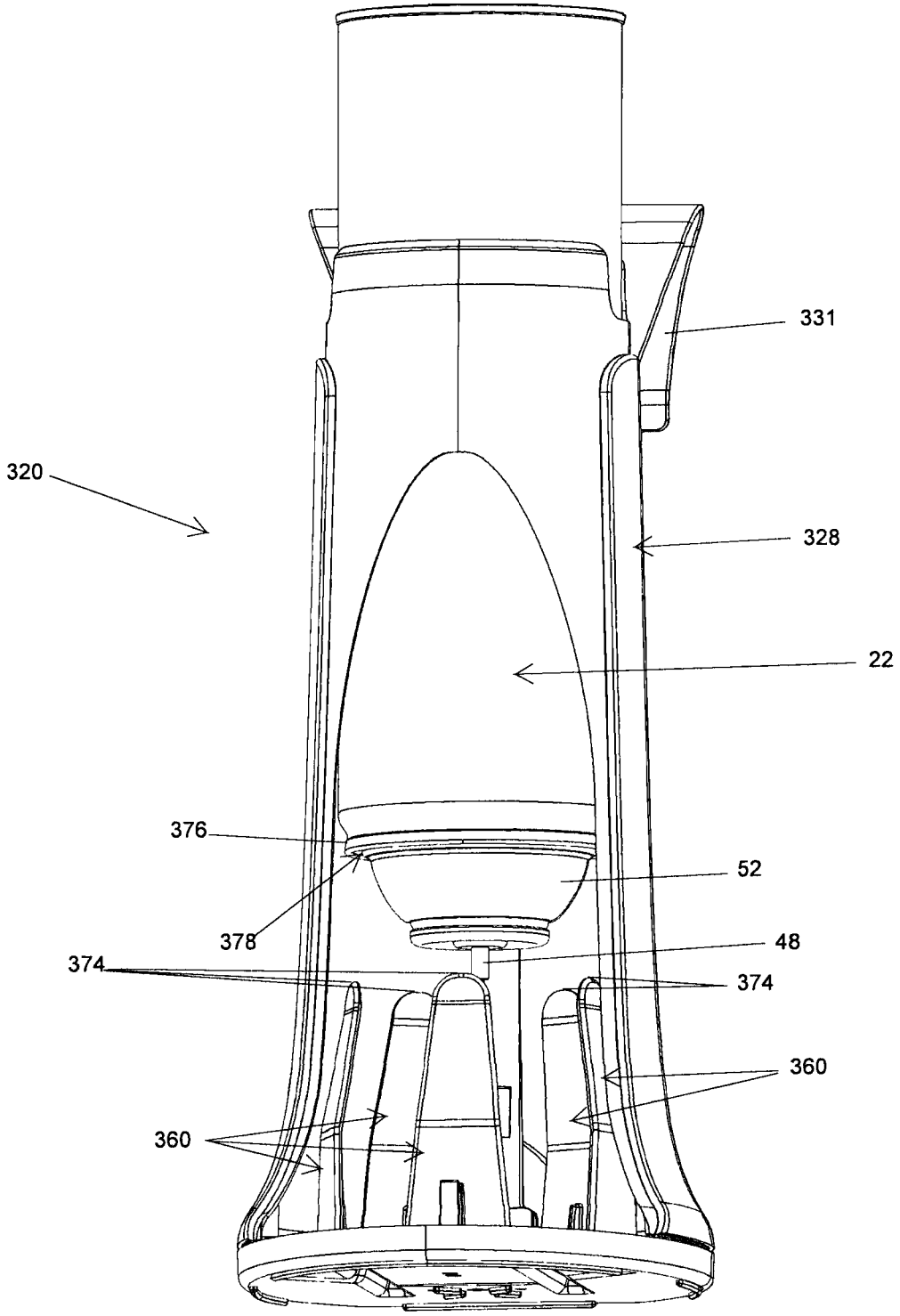
FIG. 18 is a perspective view of the holder of FIG. 16 during attempted installation of a container without a retainer.

Turning now to FIGS. 16-18, there is shown a perspective view of a second embodiment of a holder 320 in accordance with the invention. The holder 320 can delivering fluid to a conduit, such as fluid conduit 18 in FIG. 1A. As shown in FIG. 16, the holder 320 houses a container 22, which may be an aerosol container. The holder 320 includes a base 328 and a triggering device (not shown in FIG. 16) that is identical to the triggering device 30 of FIGS. 2 and 3. The triggering device for the holder 320 includes a first flange that is located on one end of the triggering device and a second flange that is located on an opposite end of the triggering device as in the triggering device 30 of FIG. 3.

The base 328 may be configured such that it is assembled from two parts: a front portion 328*a*, and a back portion 328*b*. The front portion 328*a* adjoins with the back portion 328*b* to form the base 328 as shown in FIG. 16. The base 328 includes a base wall 329 and a hanger 331. The base 328 includes a manifold 332 that is located near the bottom of the base 328. The manifold 332 includes an inlet, an outlet, and a fitment, similar to the manifold 32 depicted in FIG. 6. The inlet of the manifold 332 is in fluid communication with the outlet of the manifold 332.

The container 22 is housed within the holder 320 by a retention mechanism. The container 22 may be an aerosol container with a valve stem 48, as shown in FIG. 18. The container 22 is assembled with a retainer 350 before housing the container 22 in the holder 320. The container 22 and the retainer 350 create a refill that is assembled by placing the retainer 350 over the dome 52 of the container 22. The retention mechanism also includes five equally spaced fingers 360 that extend upwardly from the bottom wall 362 of the base 328. Each finger 360 includes a bottom section 366 and an upper section 368 that is angled inward toward the central longitudinal axis of the base 328. The retention mechanism is not limited to five fingers, as any number of two or more fingers can work.

FIG. 17 shows the holder 320 during installation of a refill. A user holds onto the container 22 and advances the retainer 350 downward toward the fingers 360. With continued downward movement, the upper section 368 of each finger 360 comes into contact with the sloped side wall 372 of the retainer 350. This flexes the upper section 368 of each finger 360 away from the central longitudinal axis of the base 328. With continued downward movement, the retainer 350 engages the manifold 332 with the valve stem 48 engaging the fitment of the manifold 332, similar to the manifold 32 depicted in FIG. 6.

Looking now at FIG. 18, it can be explained what happens during attempted installation of the container 22 without the retainer 350. A user would hold onto the container 22 and advance the container 22 downward toward the fingers 360. However, because the retainer 350 is not available to flex the upper section 368 of each finger 360 away from the central longitudinal axis of the base 328, a top edge 374 of each finger 360 enters a groove 378 between the dome 52 and the chime 376 of the container 22. This prevents continued downward movement and therefore, the valve stem 48 of the container 22 cannot engage the fitment of the manifold 332.

It can be appreciated that the retainer 350 and each finger 360 of the retention mechanism provide a means by which only a container 22 having the retainer 350 can be advanced such that the valve stem 48 of the container 22 engages the fitment of the manifold 332. When a user attempts to install a container without the retainer 350 into the holder 320, the fingers 360 prevent engagement of the valve stem 48 of the container 22 with the fitment of the manifold 332. In this case, operation of the device is not possible as fluid cannot flow from the valve stem 48 to the manifold 332.

Various cleaning and/or deodorizing chemicals are suitable for use with a toilet bowl cleaning device according to the invention. For example, mildly acidic and near neutral pH antimicrobial compositions such as those described in U.S. Pat. Nos. 6,471,974 and 6,162,371 can be advantageous when used with a toilet bowl cleaning device according to the invention. Alkaline antimicrobial toilet bowl cleaning formulations such as those described in U.S. Pat. No. 6,425,406 can also be advantageous. Acidic compositions such as those described in U.S. Pat. No. 6,812,196 may also be suitable. When using a steel container and acidic compositions, a steel container with a plastic liner or a bladder with a surrounding propellant may be desirable to minimize acidic corrosion of the steel container. Aluminum containers may also be an option for acidic compositions. The above chemicals are non-limiting illustrative examples of cleaning and/or deodorizing chemicals suitable for use with a toilet bowl cleaning device according to the invention. Other example suitable chemicals include, for example, enzymes, chelating agents, corrosives and amino acids.

Although the present invention has been described in detail with reference to certain embodiments, one skilled in the art will appreciate that the present invention can be practiced by other than the described embodiments, which have been presented for purposes of illustration and not of limitation. Therefore, the scope of the invention should not be limited to the description of the embodiments contained herein.

INDUSTRIAL APPLICABILITY

The present invention provides a toilet bowl cleaning device for spraying an inner surface of the toilet bowl, and/or the toilet water, and/or under the toilet rim with a cleaning and/or deodorizing chemical. The toilet bowl cleaning device includes a hand or foot actuated lever for releasing a fluid from the container into a fluid delivery system and a clip for mounting a fluid sprayer adjacent an inner wall of the toilet bowl.

All documents cited in the Detailed Description of the Invention are, in relevant part, incorporated herein by reference; the citation of any document is not to be construed as an admission that it is prior art with respect to the present invention.

What is claimed is:

1. A holder for receiving a container with fluid that has a valve stem, the holder comprising:

a base including a manifold having an inlet, an outlet, and a fitment to engage the valve stem, the inlet being in fluid communication with the outlet;

a triggering device including a first flange on one end of the triggering device and a second flange on an opposite end of the triggering device, the triggering device configured to move between a first position and a second position, the first flange and the second flange each being accessible to a user;

wherein the triggering device is configured to move from the first position to the second position upon the user applying a force to at least one of the first flange and the second flange, and the triggering device engages the container in the second position such that the fitment moves the valve stem relative to the container to supply fluid to the inlet.

2. The holder of claim 1, wherein the first flange extends away from the triggering device in a first direction, the second flange extends away from the triggering device in a second direction, the first direction being opposite from the second direction.

3. The holder of claim 1, wherein the first flange forms a top portion of the holder.

4. The holder of claim 1, wherein the triggering device engages the container in moving to the second position by contact of the first flange with the container.

5. The holder of claim 1, wherein the container includes a retainer, and the base includes two or more fingers dimensioned such that each of the fingers flexes outwardly when contacted by the retainer during installation of the container in the holder.

6. The holder of claim 1, wherein the triggering device moves from the first position to the second position from a user's hand applying the force to the first flange.

7. The holder of claim 1, wherein the triggering device moves from the first position to the second position from a user's foot applying the force to the second flange.

8. The holder of claim 1, wherein the triggering device further includes a triggering device wall projecting from the first flange, wherein the triggering device wall is configured to support a side of the container and to slide between the container and the base when the triggering device moves from the first position to the second position.

9. The holder of claim 1, further comprising a check valve, the check valve being downstream of the outlet.

10. A device for spraying an inner surface of a wall of an enclosure with a fluid, the device comprising:

a container for the fluid;

a holder, the holding including:

a base including a manifold having an inlet, an outlet, and a fitment to engage the valve stem, the inlet being in fluid communication with the outlet;

a triggering device including a first flange on one end of the triggering device and a second flange on an opposite end of the triggering device, the first flange and the second flange each being accessible to a user, the triggering device configured to move between a first position and a second position, the triggering device being configured to move from the first position to the second position upon the user applying a force to at least one of the first flange and the second flange, the triggering device engaging the container in the second position such that the fitment moves the valve stem relative to the container to supply fluid to the inlet;

a fluid conduit in fluid communication with the outlet and a fluid sprayer; and means for attaching the fluid sprayer near the inner surface of the wall of the enclosure.

11. The device of claim 10, wherein the first flange extends away from the triggering device in a first direction, the second flange extends away from the triggering device in a second direction, the first direction being opposite from the second direction.

12. The device of claim 10, wherein the first flange forms a top portion of the holder.

13. The device of claim 10, wherein the triggering device engages the container in moving to the second position by contact of the first flange with the container and the container is moved downward through contact with the first flange.

14. The device of claim 10, wherein upon the triggering device engaging the container in the second position, fluid exits the container, travels through the conduit, moves through the fluid sprayer, and is sprayed on the wall of the enclosure.

15. The device of claim 10, wherein the enclosure is a toilet bowl.

16. A refill for a sprayer system including a container holder and a fluid conduit in fluid communication with an outlet of the container holder and a fluid sprayer, the refill comprising:

a container; and a retainer connected to the container, the retainer including a cylindrical projection extending outwardly from the retainer with a cavity in the projection, wherein the cavity in the projection of the retainer is configured to receive a fitment that forms part of the container holder to retain the refill in the container holder.

17. The refill of claim 16, wherein:

the container is an aerosol can having a valve cup rim surrounding a valve stem, and the retainer includes a central annular wall dimensioned to engage the valve cup rim.

18. The refill of claim 17, wherein:

a portion of the retainer engages a dome of the aerosol can.

19. The refill of claim 16, wherein the cavity and fitment are cylindrical in shape.

* * * * *